United States Patent [19]

Hart et al.

[11] Patent Number: 4,563,841

[45] Date of Patent: Jan. 14, 1986

[54] INTERNAL GRIT BLAST WELD JOINT CLEANER

[75] Inventors: Milburn L. Hart, Tulsa; Robert J. Hart, Oologah, both of Okla.

[73] Assignee: Resource Engineering & Manufacturing Company, Tulsa, Okla.

[21] Appl. No.: 623,345

[22] Filed: Jun. 22, 1984

[51] Int. Cl.[4] ..... B24C 3/32

[52] U.S. Cl. ..... 51/411; 51/424; 51/437; 51/434; 118/DIG. 10

[58] Field of Search ..... 51/34 C, 34 H, 271, 51/274, 319, 411, 424, 428, 429, 431, 432, 434, 435, 436, 437, 438; 15/104.09, 104.15, 104.16; 118/72, 306, DIG. 10

[56] References Cited

U.S. PATENT DOCUMENTS

| | | | |
|---|---|---|---|
| 3,058,137 | 10/1962 | Doyle et al. | 118/DIG. 10 |
| 3,125,464 | 3/1964 | Harmes | 118/DIG. 10 |
| 3,135,629 | 6/1964 | McLean | 118/DIG. 10 |
| 3,477,178 | 11/1969 | Hulbert | 51/411 |
| 3,824,738 | 7/1974 | Hall | 51/411 |
| 3,967,584 | 7/1976 | Hasegawa et al. | 118/DIG. 10 |
| 4,092,950 | 6/1978 | Hart | 118/DIG. 10 X |
| 4,177,734 | 12/1979 | Rhoden | 118/DIG. 10 X |
| 4,329,819 | 5/1982 | May | 51/434 X |

FOREIGN PATENT DOCUMENTS

| | | | |
|---|---|---|---|
| 887144 | 12/1981 | U.S.S.R. | 51/411 |

*Primary Examiner*—Robert P. Olszewski

*Attorney, Agent, or Firm*—William S. Dorman

[57] ABSTRACT

A machine for cleaning the interior uncoated surfaces surrounding the weld joints in an otherwise internally coated pipeline comprising a first plate mounted on the machine and extending transversely across the pipeline when the machine is disposed within the pipeline, a second plate mounted on the machine in spaced parallel relation with the first plate, a first resilient member mounted on the first plate and having a circular periphery for engaging the inner periphery of the pipeline wall, a second resilient member mounted on the second plate and having a circular periphery for engaging the inner periphery of the pipeline wall, the first and second plates with their attached resilient members forming a closed cleaning chamber sealed at its ends with respect to the pipeline, a hollow rotatable hub mounted on the machine and within the cleaning chamber and rotatable on an axis substantially co-axial with the longitudinal central axis of the pipeline, a plurality of hollow tubes extending radially outward from the hub and in communication with the interior of the hub, a motor for rotating the hub whereby air is forced outwardly through the tubes to create a partial vacuum within the interior of the hub, arrangement for supplying particulate abrasive material to the interior of the hub whereby the vacuum created upon rotation of the hub will cause the particulate material to be propelled outwardly against the interior of the pipeline wall, wheels for moving the machine so as to position the radial tubes in alignment with a weld joint whereby, upon rotation of the hub and upon supplying the hub with particulate abrasive material, the tubes will propel the particulate material against the weld joint to clean the same by a sand blasting effect, a rotary disc and linkage acting in timed response to the initial rotation of the hub for oscillating the plates and hub as a unit longitudinally with respect to weld joint whereby the tubes will move alternately back and forth across the weld joint to clean the entire weld joint area, and a vacuum head for removing accumulated spent particulate material and blasted-off material continuously from the cleaning chamber.

8 Claims, 15 Drawing Figures

INTERNAL GRIT BLAST WELD JOINT CLEANER

BACKGROUND OF THE INVENTION

1. Field of the Invention

The present invention relates to an internal weld joint cleaner, and more particularly, to a weld joint cleaner designed to travel within an internally coated pipeline and clean the interior of said pipeline in the cutback area which surrounds the weld joint and extends up to a point where previously applied internal coating ceases, such area being filled with flux and residue from welding two pipe joint sections together.

2. Prior Art

The present invention relates to a pipeline which is made up from pipe sections which have been previously coated at the mill except for the ends thereof which are left uncoated so that the sections can be welded together in the field in an end-to-end relation. In this particular case, we are concerned with a pipeline which is internally coated; that is each pipe section is previously internally coated except for a band extending about 4–8 inches back from the end of each pipe section. This band is sometimes referred to as the cut-back area. Thereafter, the pipe sections are welded together in the field which means that there will be a total area of 8–16 inches of bare or uncoated pipe around each weld joint which must be cleaned prior to the application of a coating over the weld joint. The added coating will overlap with the internal coating which has been previously applied at the mill.

A machine for coating the uncoated weld joints in an otherwise internally coated pipeline is disclosed in Hart U.S. Pat. No. 4,092,950 issued on June 6, 1978; however, in order to effectively employ the apparatus of Hart U.S. Pat. No. 4,092,950, the weld joints must be thoroughly cleaned to provide a proper surface for receiving the coatings.

The basic method of cleaning the internal weld joints of an internally coated pipeline, of the type described above, has previously involved a spinning wire brush of the type shown in Hasegawa et al U.S. Pat. No. 3,967,584 issued on July 6, 1976; this method, however, is difficult to control, the operation generally affects the previously applied mill coating and the cleaning itself is inferior to the cleaning effected by sand blasting or grit blasting. Attempts have been made and proposed to abrasively blast the internal weld joints manually, and sometimes automatically but these attempts so far have met with little success. As far as sand blasting or grit blasting itself is concerned, a device for abrasive-blast cleaning of the end of a pipe prior to welding is shown in Hart U.S. Pat. No. 3,972,149 issued on Aug. 3, 1976.

In the present invention, after the grit blast weld cleaner has been properly located over the weld joint, and after the grit blast cleaning operation has continued for a period of time, the weld joint cleaner is caused to oscillate longitudinally with respect to the weld joint. The present inventors are not aware of any prior art device which involves an oscillation of the weld joint cleaner with respect to the weld joint.

SUMMARY OF THE INVENTION

The present invention relates to an internal weld joint cleaner designed to travel within an internally coated pipeline and clean the interior of said pipeline in the uncoated cutback area which surrounds the weld joints in the pipeline. The weld joint cleaner of the present invention is a machine adapted to travel along the interior of a pipeline whose weld joints must be cleaned preparatory to the coating of these joints. The machine is composed of a plurality of modules which are segmentally connected, similar to cars on a train. It is designed to travel within a pipeline and to clean areas adjacent to the field girth weld. These areas, referred to as cut-back areas since they extend up to a point where previously applied internal coating ceases, are filled with flux and residue from welding two pipe sections together.

The various modular components which make up this machine or system are: (1) a Cleaning Head Module; (2) a Grit Supply Module; (3) a Prime Mover/Battery Pack Module; and (4) a Generator Module. The configuration of the modular units can be rearranged simplistically because of the bulkhead/rod type of construction used in this invention. The modules described above include a plurality of spaced bulkheads which generally divide the machine into a series of articulated sections. Certain of the bulkheads connect with each other by a plurality of circumferentially arranged rods which are bolted at their ends to these bulkheads. Also, certain of adjacent bulkheads are connected to each other by means of universal joint connections to provide the articulation referred to herein.

The cleaning head module comprises a throwing wheel hub connected to a plurality of radially mounted, spoke-like hollow tubes which are commonly connected to a hollowed out cavity in the hub. The cleaning head also includes a pair of cleaning cavity seals. The first seal is mounted on a forward plate and the second seal is mounted on a rear plate located on the opposite side of the throwing wheel. These seals and fit up against the pipeline wall thereby creating a cleaning chamber capable of completely containing all of the grit dispensed from throwing wheel tubes. A snorkel-shaped breathing port passes through the front seal and plate where it is downwardly baffled at its lower end to prevent grit from bouncing out. A vacuum head projects downwardly through the rear plate into the cleaning chamber where it reaches to within a close proximity of the bottom of the inner pipeline wall. The vacuum head picks up grit and blasted-off material from the cleaning chamber and passes it through the rear plate where it then attaches to a pair of flexible hoses which carry the grit back to the grit supply module.

The grit supply module contains a reservoir vat consisting of a pair of side-by-side grit supply hoppers, a vacuum chamber, three fans, a pair of side by side air compressors, an air storage tank plus attendant electrical switching terminal plates. A corrugated flexible hose connects the vacuum pickup head in the cleaning head module with a grit return tube which passes into the grit supply hoppers. The hoppers are separated by a vat divider wall which the grit return tube ultimately continues through before reaching a final deposit site in rear hopper. The grit deposit or reservoir end of the grit return tube is L-shaped to provide access to both grit supply hoppers for the purpose of depositing returning or reclaimed grit. Each opening of this L-shaped tube is covered by a free-suspended flapper valve. The "straight" portion of the tube which carries one flapper valve passes into the rear hopper; the right angled end of the return tube which carries the other flapper valve terminates within the forward hopper. The function of these aforementioned flapper valves is to allow the vacuum in one chamber to open its respective flapper valve and thus close the other hopper's flapper valves thus allowing grit to return to the hopper under vacuum as determined by the LOGIC to be discussed later.

The grit supply hoppers have small discharge ports at their bottoms and a pair of rod valves mounted within the hoppers are operated together or alternately by a pair of air cylinders which control the opening or closure of the discharge ports. A pair of suction tubes closeable at their outer ends within the vacuum chamber pass into the rear hopper and the forward hopper, respectively. A pair of disc valves operated by a pair of pneumatic cylinders alternately open and close the suction tubes. A trio of vacuum fans are mounted externally of the vacuum chamber. The intake inlets of these fans are formed by openings through the bulkhead which forms one of the outer walls of the vacuum chamber. Also, in the grit supply module are a pair of electrically operated air compressors and an air storage tank which attach to bulkheads within this module. Compressed air, which is provided at 40–60 psi by these compressors, is utilized to provide air power to many solenoid-operated valves which control the various cylinder-operated functions throughout the present invention and to provide actuating power for these cylinders. A hopper vent valve at the top of the grit supply hoppers communicates with the hoppers on opposite sides of the divider wall and connects to an actuating rod which is operated by a pneumatic cylinder to alternately vent the hopper chambers to atmosphere according to the LOGIC to be described later.

Below the two grit storage hoppers is a single tube which is open at its left end. This open-ended pipe (open to take in outside air and to receive grit via the discharge ports) carries grit forward towards the central cavity of the throwing hub via a hose. The open-end provides a continuous air flow because of the vacuum created by the rotation of throwing wheel through said hose, thus creating a dynamic force which propels the grit in the air current towards the throwing wheel.

The prime mover/battery pack module contains a pair of power drive units, a battery pack supply section, a brake mechanism and a stabilization mechanism or assembly. Each of the power drive units consists of a pair of drive wheels, a pair of drive motors and a pair of reducing gear boxes. The two pairs of wheels are located one above the other in the same vertical plane. The wheels are tapered at a 22° angle to provide maximum contact with the pipeline wall. A pair of cylinders are mounted within the power drive section for urging the upper pair of drive wheels away from the lower drive wheels and, hence, into forced contact with the upper portion of the pipeline wall. The cylinders are used to provide extra traction force through the upper power wheels especially during periods when the lower wheels encounter mud, rusty water, and/or oil or other debris within the pipeline wall. The prime mover/battery pack module also contains a battery portion including three pairs of batteries which make up the battery power pack. This series of batteries allows the present cleaning machine to be used until the engine is able to generate its own power within the pipeline or for bringing the unit out of the pipeline in case of engine failure.

The prime mover/battery pack module further contains a locking brake mechanism consisting of a curved, locking brake shoe which is curved to fit a variety of pipe diameters. An air-actuated cylinder forces the brake shoe against the pipeline wall when the cleaning process is running and serves to release and retract the brake shoe when the process is not running or when the machine needs to travel down the pipe to the next weldment site. Finally, the prime mover/battery pack module includes a stabilization mechanism or assembly which consists of a pair of high friction, rubber roller-castors or wheels attached to a stabilizer bar. One wheel is canted 2° toward the left of the longitudinal axis of the pipeline; the other wheel is positioned 2° toward the right of the longitudinal axis of the pipeline. The stabilizer bar is mounted on the vertical section of an L-shaped arm which is further connected to and activated by a spring-centered pneumatic cylinder which is triggered by a pair of mercury limit switches (not shown). For example, one switch is tripped when the machine rotates left more than 10° from its vertical axis. This causes the stabilizer bar to pivot or rotate thereby pushing the appropriate castor up against the pipe wall until an upright position is achieved. If the machine would over-correct and rotate 10° to the right, the other mercury limit switch would activate causing the other castor to be pushed up against the pipe wall thereby righting the cleaner. The mounting of the wheels at a 2° angle off center from the horizontal axis of the pipe allows the machine to assume a correct upright position slowly. So long as the machine remains within 10° of a normally upright position within the pipeline, the mercury switches are both de-energized thereby causing the stabilizing bar to remain level thus preventing both castor wheels from making contact with the pipe.

The generator module broadly includes an extra large capacity fuel storage tank, a gasoline or diesel engine, a pair of alternators and a pair of electronic controller boxes. The extra large capacity gasoline tank is located between a pair of bulkheads and is separately walled and sealed off from the rest of the system. The engine is mounted adjacent a pair of alternators or generators. A pair of pulley wheels connected to a spin input shaft coming from the engine are drive by a pair of pulley belts which are further connected over a pair of generator pulley wheels which, in turn, are mounted on a pair of generator output shafts. The electrical power produced by the alternators drives the motors of the prime mover drive assembly.

The electronics LOGIC connected with the present invention is also mounted on the generator module; this LOGIC provides for several functional unit operations throughout the modules. The unit cycle operating sequence and timing are controlled by such equipment as that manufactured by General Electric Corporation and International Test Equipment Company. The electronics LOGIC is centered within a pair of conroller modules mounted on the terminal bulkhead of the generator module, except for the isotope sensing unit which is mounted on a plate located in the cleaning head module.

One of the novel features of the present invention involves the oscillation of the cleaning unit. The oscillation of the cleaning head unit occurs because of its attachment to an oscillation unit which is located in the cleaning head module but which connects with the universal joint which articulates the cleaning head module to the adjacent grit supply module. The oscillation unit includes an oscillating motor which is mounted on a bulkhead within the cleaning head module and which drives a gear box having an output shaft connecting to a rotatable disc. The disc connects with one end of a connector rod, the other end of which connects with one pair of ends of a pair of rigid rods which are slidably mounted within a pair of linear bushings. The linear bushings extend through the terminal bulkhead in the cleaning head module. The other ends of the rigid rods connect with a universal joint which, in turn, connects with the initial bulkhead on the grit supply module. The rigid shafts remain stationary while the entire forward cleaning head module oscillates along them. Two linear bushings are used to provide rigidity and stability so the cleaning head module cannot rotate sideways or ride up the pipe wall. When the process controller (located in the generator module) signals the cleaning head unit, the linear bushings allow the entire cleaning head module to move back and forth along a longitudinal axis as the bushings move back and forth on the rigid rods reciprocated (relatively) by the circular disc, thereby causing the forward cleaning head module to oscillate back and forth. Therefore, an area on either side of the weldment gets cleaned as well as the weld itself.

DETAILED DESCRIPTION OF THE PREFERRED EMBODIMENTS

The internal grit blast weld joint cleaner of the present invention is segmentally connected, similar to cars on a train. It is designed to travel within a pipeline and to clean areas adjacent to the field girth weld W. These areas, referred to as cut-back areas since they extend up to a point where previously applied internal coating ceases, are filled with flux and residue from welding two pipe sections together.

The over-all operation of the present invention is best described by reference to the various modular components (see FIG. 1) which make up this system. They are: (1) the Cleaning Head Module A; (2) the Grit Supply Module B; (3) the Prime Mover/Battery Pack Module C; and (4) the Generator Module D. The configuration of the modular units can be rearranged simplistically because of the bulkhead/rod type of construction used in this invention.

Figure 2:
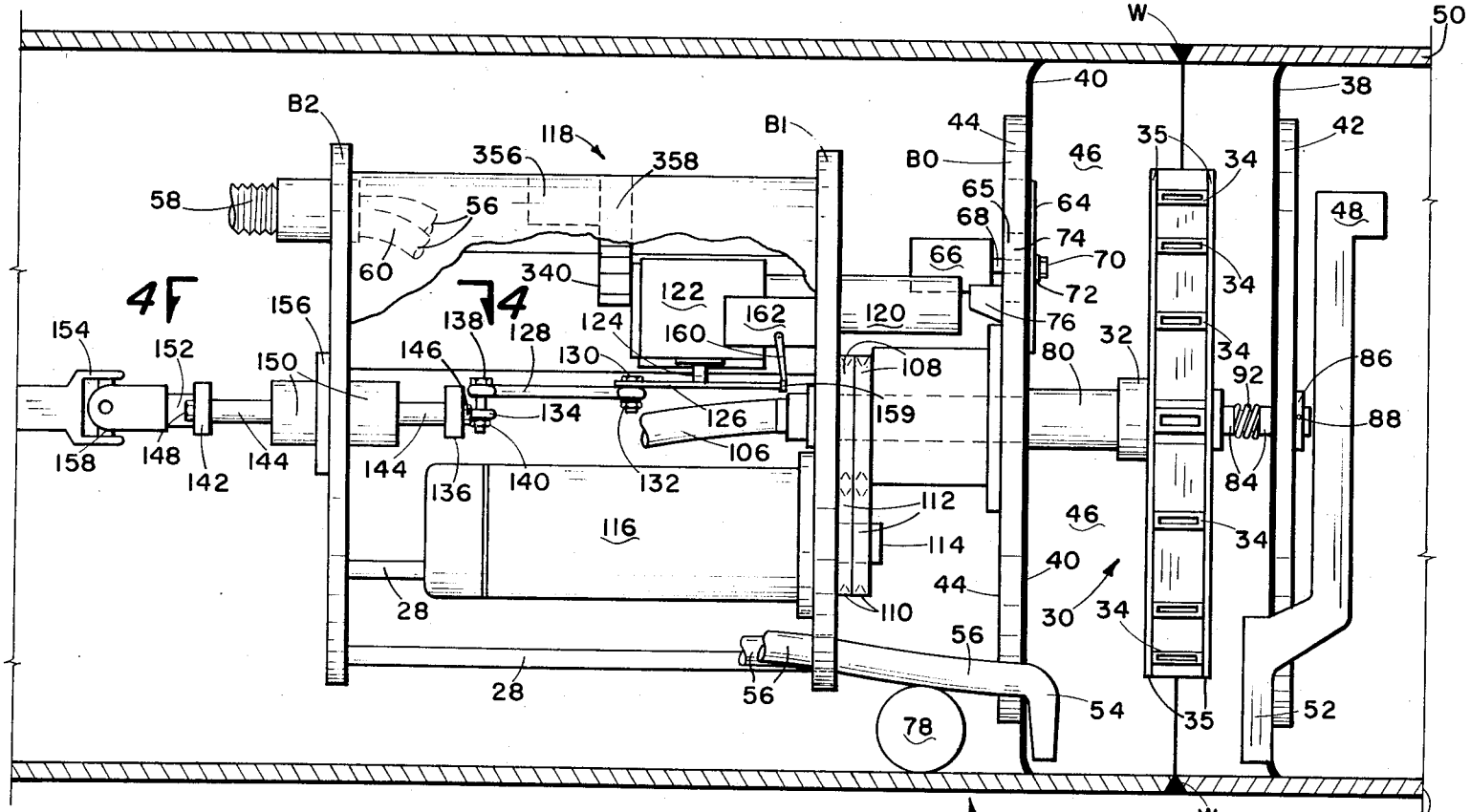
FIG. 2 is a front elevation, on a larger scale than FIG. 1, showing the cleaning module appearing at the lower right hand end of FIG. 1.

The modules described above include a plurality of spaced bulkheads which generally divide the invention into a series of articulated sections as will appear hereinafter. For example, the Cleaning Module A includes bulkheads B0, B1, and B2. The Grit Supply Module B includes bulkheads B3, B4, and B5. The Prime Mover/-Battery Pack Module C includes bulkheads B6, B7, and B8. The Generator Module D includes bulkheads B9, B10, B11, and B12. Bulkheads B0, B1, and B2 connect with each other by a plurality of circumferentially arranged rods 28 (two of which are shown in FIG. 2) which are bolted at their ends to these bulkheads. Bulkheads B3, B4, and B5 connect with each other by means of similar rods which pass through the bulkheads and are bolted at their ends to bulkheads B3 and B5. Similarly, bulkheads B6, B7, and B8 and bulkheads B9, B10, B11, and B12 are connected to each other, respectively, in the same manner. In order to provide the articulation, bulkhead B2 is connected to bulkhead B3 by means of a universal joint connection 154 as will be described hereinafter. The same considerations hold true for the connection of bulkhead B5 to bulkhead B6 and for the connection of bulkhead B8 to B9.

I. Cleaning Head Module A

The cleaning head unit 30 comprises one part of the Cleaning Head Module A. The cleaning head 30 (see now FIGS. 2, 3, and 4) contains a throwing wheel hub 32 consisting of radially mounted, spoke-like hollow tubes 34 which are commonly connected to a hollowed out cavity 36 in the hub. Said tubes 34 ar also welded to a pair of metal windbreaker plates 35 which, as mounted, allow the cleaning head 30 to more evenly distribute grit particles. The cleaning head 30 also includes a pair of rubber cleaning cavity seals 38 and 40. The first seal 38 is mounted on a forward plate 42 and the second seal 40 is mounted on a plate 44 (also known as B0) located on the opposite side of the throwing wheel. These seals 38 and 40 fit up against the pipeline wall 50 thereby creating a cleaning chamber 46 capable of completely containing all of the grit dispensed from throwing wheel tubes 34. Both seals 38 and 40 are located on the cleaning chamber side of their mounting plates in order to reduce abrasion. A snorkel-shaped breathing port 48 passes through the front seal 38 and plate 42 where it is downwardly baffled at its lower end 52 to prevent grit from bouncing out.

A vacuum head 54 projects downwardly through plate 44 (B0) and rear seal 40 into the cleaning chamber 46 where it reaches to within a close proximity of the bottom of the inner pipeline wall 50. The head 54, shaped in a shallow cure to allow maximum suction, picks up grit from the inner cleaning cavity 46 and passes it through the rear seal 40 and plate 44 where it then attaches to a pair of flexible hoses 56 which carry the grit back to a central line hose 58 which is located between the B2 and B3 bulkheads as will be described later.

The hoses 56 pass through bulkhead B1 and on toward bulkhead B2 where they curve upward and attach to a Y-coupling 60 which passes through bulkhead B2. The Y-coupling 60 reduces to a single fitting as it passes through bulkhead B2 thus further connecting with another section of flexible corrugated hose 58 which attaches to the next module. The hose 58 carries the suctioned grit to the return supply vat 62 (which is in Module B, later to be described).

Also, in the rear cavity seal plate 44 (B0) is a ventilation port valve or disc 64 (although only one is shown, there may be as many as three) disposed over a ventilation port 65 in the plate 44. Disc 64 is opened and closed by a small pneumatic cylinder 66 attached to a cylinder rod 68. The ventilation port valve 64 mounts at the front end of the cylinder rod 68 and is secured thereto by a lock nut 70 and a washer 72. The cylinder 66 is connected to the rear plate 44 via a mounting bracket 76. Two air hoses (not shown) connect the cylinder 66 with the rest of the solenoid-operated system to be described later in the LOGIC in FIGS. 13, 14, and 15. When air is supplied to the cylinder 66, the valve or disc 64 will move to the right to permit air to pass through the plate 44.

A pair of wheels 78, located at the bottom of the cleaning unit 30, are the first of a series to be found throughout the length of the present invention. They are radially mounted at a 45° angle so as to more capably bear the weight of each section to which they are attached. This first pair of wheels 78 connect to the cleaning head by suitable axles and brackets (not shown) in a conventional manner.

The throwing wheel hub 32 (see also FIG. 3) is attached to one end of a hollow tubular shaft 80 which rotates around a hollow non-rotatable tube 82 of smaller diameter than the shaft 80. The right hand end of the tube 82 is welded to the left end of a split support shaft 84 whose right hand section passes through the front rubber seal 38 and plate 42. The right end of 84 is welded to a spring 92 before continuing on forward through front plate 42. The shaft 84 is attached to the plate 42 by a clamp 86 which is held in place with a set screw 88. The left section of shaft 84 passes through a pilot bearing 90 mounted in the forward section of the throwing wheel hub 32. The spring 92, welded between the sections of the split shaft 84 (between the throwing wheel hub 32 and front seal 38) allows greater flexibility to the forward seal plate 42, especially when the whole cleaning modular unit travels around a curve in the pipeline.

The right end of the rotary 80 ends in a central tapered cavity 36 within the hub 32 where the shaft and the cavity both taper outward at a 21° angle before connecting with the spoke-like throwing tubes 34. The tubes receive grit from the 21° tapered central cavity 36 which communicates with the interior of the non-rotatable tube 82 through four oval-shaped, grit emission ports 94 thereby allowing grit to be evenly propelled via gravity and centrifugal force out of the throwing arms 34 into the cleaning cavity 46.

The shaft 80 for rotating the throwing wheel hub assembly 32 passes through plate 44 (B0), which acts as a backing for the rear rubber seal 40 and into a bearing assembly 96 which includes two pairs of bearings 98 and 100. Bearings 98 abut against a shoulder 81 on the shaft 80. The bearing assembly 96 is bolted to plate 44 (bulkhead B0) by a plurality of nuts 102 and bolts 104. The rotating shaft 80 terminates in close proximity to bulkhead B1 within 1/32 inch, but not touching bulkhead B1. This close proximity (not shown) allows small amounts of air to be pulled by the suction of the rotating hub assembly 32 into the annular space formed by the rotating shaft 80 and stationary feed tube 82.

The throwing flywheel (hub) 32 rotates at approximately 3200 RPM's, causing the radial tubes 34 to become an air pump, creating a partial vacuum in the cavity 36 and a decreased pressure on a grit access hose 106 connected to the left-hand end of the tube 82 and leading from the bottom of grit supply hoppers (later to be described) which are in Module B. When grit enters through hollow intake feed tube 82, it is pulled into the conically-shaped, centrally-walled cavity 36, and is thrown out of the four emission port holes 94. Since the throwing wheel is centered within the pipe at the weld W and is surrounded by rubber seals 38 and 40, the high velocity grit impinges against the inner pipe surface thus cleaning the weldment area.

After a specific, programmable period of time of cleaning the weld joint W itself, the entire Cleaning Head Module A begins oscillating longitudinally a specific distance on either side of the weld W as will be described hereinafter. Because the wheel 32 is still throwing grit, the area adjacent to the weld W is cleaned up to the edge of the previously applied mill coating.

The shaft 80 passes through the bearing assembly 96 and attaches to a double pulley 108 mounted thereon. Two V-belts 110, connect the double pulley on the shaft 80 to two lower single pulleys 112 which are mounted on the output shafts 114 respectively of two side-by-side motors 116 (only one of which is shown in FIG. 2). Thus each V-belt 110 connects the output shaft of each motor 116 separately with one of the pulleys of the double pulley on the shaft 80.

The oscillation of the cleaning head unit 30 occurs because of its attachment to the oscillation unit 118, which is oscillated in a manner to be described below. An oscillating motor 120 is mounted through the bulkhead B1 and drives a gear box 122 which has an output shaft 124 connecting it to a rotatable disc 126. Disc 126 connects with one end of a connector rod 128 by means of a bolt 130 and a nut 132. The rod 128 further connects with a common ear 134 (see now FIG. 4) wich is formed as the center section of a face plate 136. Together they receive another bolt 138 which passes therethrough and fastens these two together with a nut 140. Another end face plate 142 connects to the first face plate 136 by means of a pair of parallel rigid shafts 144 which are held in place by a pair of bolts 146 on one end and a second pair of bolts 148 on the other end.

Figure 1:
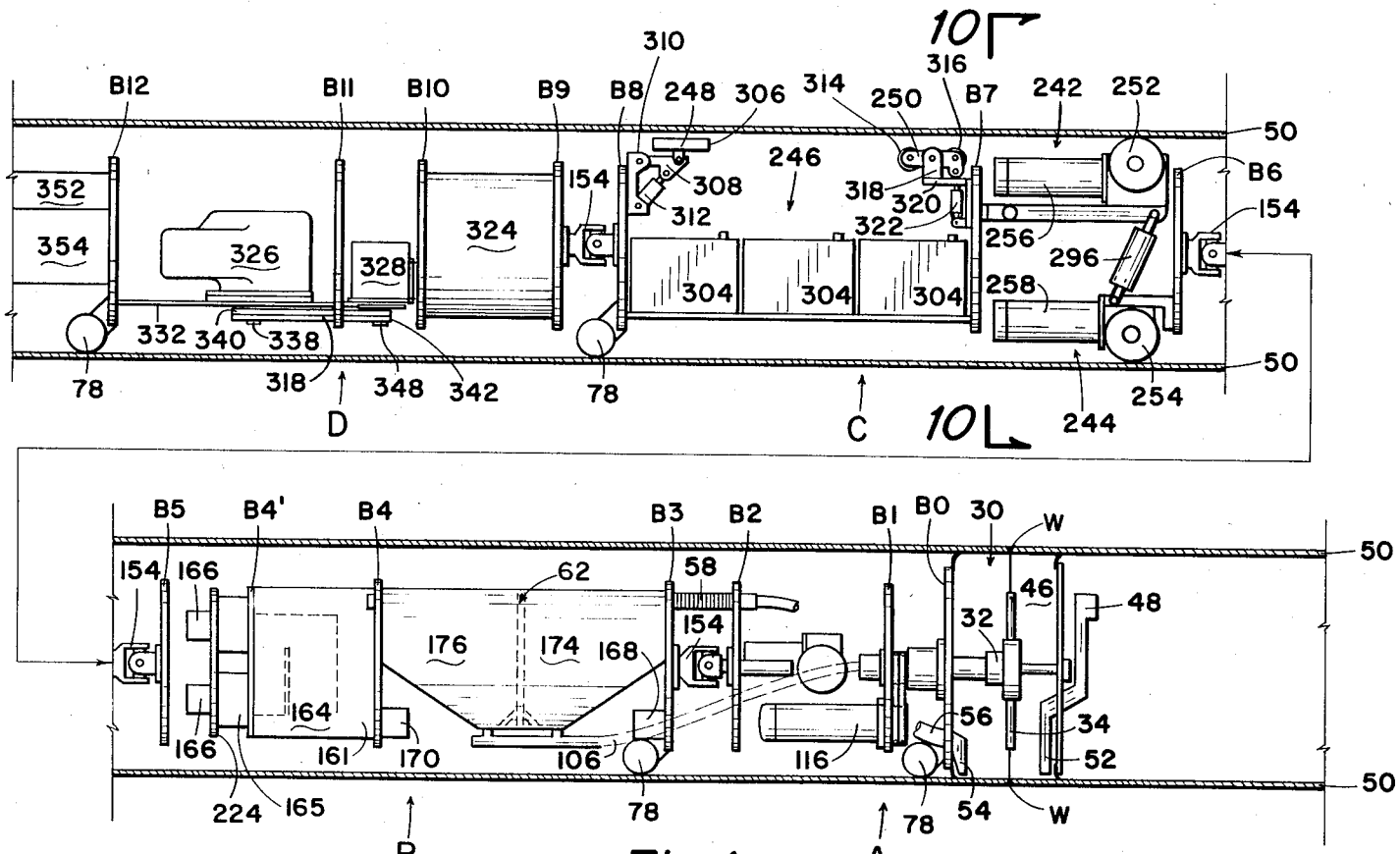
FIG. 1 is a front elevation, in two broken parts, of a grit blast welding machine constructed in accordance with the present invention, showing the machine within a pipeline which is in cross-section.

The rigid shafts 144 reciprocate through a pair of linear bushings 150. The bushings 150 are attached to a housing 156 which in turn is flange mounted to bulkhead B2. Plate 142 further connects with a post 152 which receives a Universal-joint 154 (hereinafter referred to as U-joint). Shafts 144 remain stationary while the entire forward Cleaning Head Module A oscillates along them. The left end of the U-joint 154 connects with bulkhead B3 (as shown in FIG. 1). Two linear bushings 150 are used to provide rigidity and stability so the Cleaning Head Module A cannot rotate sideways or ride up the pipe wall.

When the process controller 352 (located in the Generator Module D to be described later) signals the cleaning head unit 30, the linear bushings 150 allow the entire Cleaning Head Module A to move back and forth along a longitudinal axis as it is reciprocated by the circular disc 126, thereby causing the forward Cleaning Head Module A to oscillate back and forth. Therefore, an area on either side of the weldment gets cleaned as well as the weld W itself.

A pin 159 is attached to the periphery of the disc 126 and comes in contact with a lever arm 160 which is attached to a normally closed electrical limit switch 162. When the machine is signaled to move to the next weld joint W and has run the stationary cleaning process (to be later described in the LOGIC in FIGS. 13, 14, and 15), a latching relay is activated which starts the rotation of disc 126 which is then free to continue until an electronic signal from the process controller 352 turns it off. When the limit switch 162 is activated by the pin 159 located on disc 126, a circuit is opened thus halting the oscillation in mid-position. In other words, the pin 159 is located in such a position that the cleaning head 30 always stops right at the central point of the weld W, never at a position to either the left or right side of it.

All sections of the train are connected by universal joints 154 which allow the unit flexibility as it travels through any standard field bends. Each U-joint 154 is bolted together with a pin 158 which can be pulled to release one module from the next for repair work or other purposes.

II. Grit Supply Module B

The Grit Supply Module B itself (see now FIGS. 5, 6 and 7) is located between bulkheads B3 and B5. It broadly contains a reservoir vat 62, a vacuum chamber 164, three fans 166, a pair of side by side air compressors 168 (only one visible in FIG. 5), an air storage tank 170 plus attendant electrical switching terminal plates (not shown). The vacuum chamber 164 is formed by a cylindrical housing 161 which extends across the space between bulkhead B4 and intermediate bulkhead B4'. Vat chamber 62 is anchored between bulkheads B3 and B4 which are connected by rods 28 as previously mentioned. Rods 28 further connect bulkheads B4 and B5 to each other.

The corrugated flexible hose 58, which connects the vacuum pickup head 54, coming from Cleaning Head Module A to the adjacent Grit Hopper Module B, has sufficient compressible length to prevent damage during the oscillation cycle. This section of flexible hose 58 connects over a grit return tube 172 which passes through bulkhead B3 and then enters the uppermost portion of the first of a pair of grit supply hoppers 174 (front) and 176 (rear) mounted side-by-side as one. Together they comprise reservoir vat 62.

The hoppers 174 and 176 are separated by a vat divider wall 178 which the tube 172 ultimately continues through before reaching a final deposit site (via an L-shaped fitting) in rear hopper 176. The grit deposit or reservoir end of tube 172 is L-shaped to provide access to both separately-walled chambers 174 and 176. Access is necessary for the purpose of depositing returning or reclaimed grit. Each opening of this L-shaped tube 172 is covered by a free-suspended flapper valve 173 and 175. The "straight" portion of the tube which carries the flapper valve 175 passes through the wall 178 and terminates within the hopper 176; the right angled end of the tube 172 which carries the flapper valve 173 terminates within the hopper 174. The details of the flapper valves 173 and 175 are not illustrated because they are considered to be more or less conventional; in FIG. 6 these valves are merely shown as broadly pivoted to the right angled ends of the tube 172. However, it should be understood that these flapper valves are mounted at their upper ends over the openings in the tube 172 for pivoting about their upper ends on horizontal pivot axes (not shown) for movement away from or against the openings at the end of the tube 172. It should be further understood that these flapper valves will normally close by gravity in the absence of any pressure differential on the opposite sides of the flapper. The function of these aforementioned flapper valves is to allow the vacuum in one chamber to open it's respective flapper valve and thus close the other hopper's flapper valves thus allowing grit to return to the hopper under vacuum as determined by the LOGIC to be discussed later. (LOGIC alternates chambers every other cycle.) The reverse occurs when the LOGIC dictates need of a vacuum in the other hopper. For example, when chamber 176 is under vacuum, flapper valve 175 is open and flapper valve 173 is closed; when chamber 174 is under vacuum, the condition of the valves is reversed.

The reservoir chambers 174 and 176 are hopper-shaped on the bottom and have small discharge ports 180 and 182 therein. Within each chamber and leading to these flow control discharge ports 180 and 182 are a pair of inclined baffles 184 and 186 which further direct the grit flow to said port openings. In other words, there are V-shaped walls surrounding the ports shaped thusly to permit a better flow of grit out of each supply chamber. Were the port walls to be cylindrical, the grit might tend to stack up thereby occluding the opening.

The ports 180 and 182 receive a pair of rod valves 188 and 190 which are operated by a pair of air cylinders 192 and 194 which control the opening or closure thereof. These valves, which form V-shape points at their ends, are nose-mounted directly above each respective port on a pair of angle arm brackets 196 and 198 which connect centrally to the vat divider wall 178. However, when hose 58 is returning grit from the vacuum pickup head 54 in the Cleaning Head Module A through tube 172 in the uppermost portion of the grit supply hopper section 62, one port will be open and the other one will be closed unless they are both closed as during time of transport from one weldment site to another. (See LOGIC in FIGS. 13, 14, and 15.)

Figure 5:
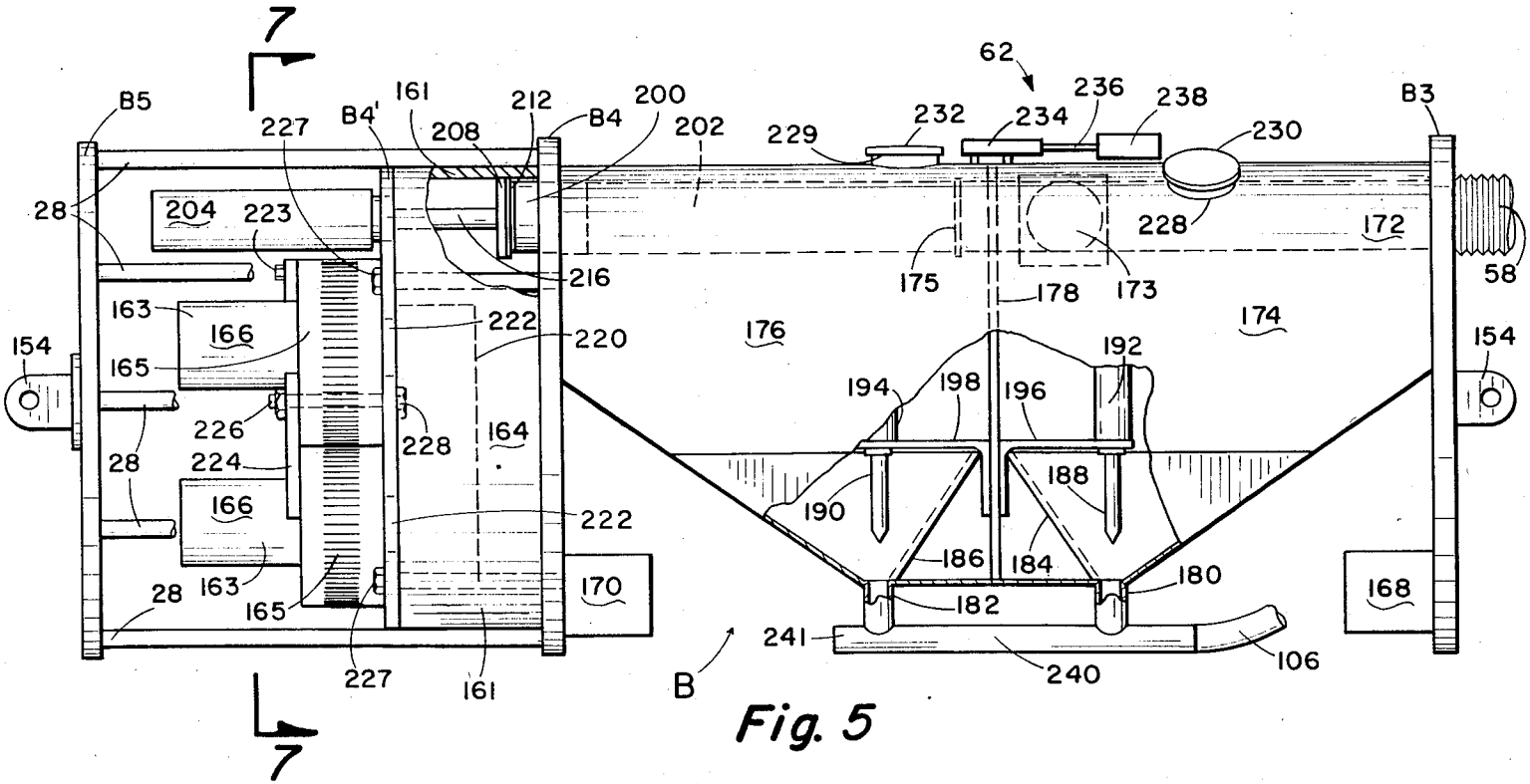
FIG. 5 is a front elevation, taken from FIG. 1 in similar fashion to FIG. 2, but showing the grit supply module and associated elements appearing to the left of the cleaning module of FIG. 1.
Figure 6:
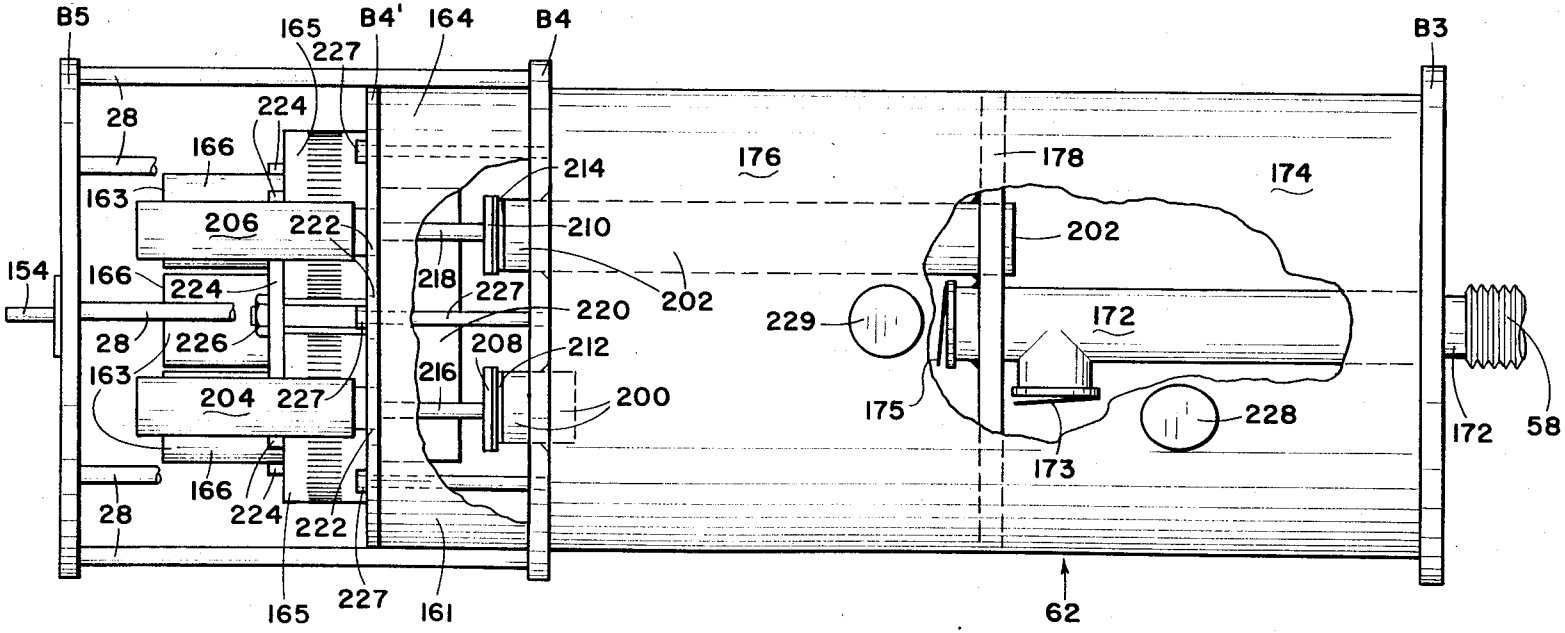
FIG. 6 is a plan view of the elements shown in FIG. 5.

FIGS. 5 and 6 show a pair of suction tubes 200 (shorter) and 202 (longer) which pass through the top of bulkhead B4. A pair of pneumatic cylinders 204 and 206 alternately open and close the tubes 200 and 202 as will appear below. Tube 200 from the vacuum chamber 164 passes through bulkhead B4 and terminates within the rear hopper chamber 176. Tube 202, which also passes through B4 from the vacuum chamber 164, extends on through hopper chamber 176, hopper divider wall 178, and opens into the forward hopper chamber 174.

Tubes 200 and 202, which allow suction to pass from chamber 164 into the rear and forward grit storage hoppers 176 and 174, respectively, are sealed from chamber 164 by a pair of discs 208 and 210 (constituting disc valves) upon which are mounted a pair of rubber seals 212 and 214. These discs and seals are mounted on a pair of actuating rods 216 and 218 which extend through B4 where they attach to said pneumatic cylinders 204 and 206 which control the alternate opening and closing thereof according to the LOGIC as diagrammed in FIGS. 13, 14 and 15. Also, located in the vacuum chamber 164 is a four-sided, closed box type, bottom open only, baffle deflector 220 which prevents occasional particles of grit from entering the inlets of fans 166 as will appear hereinafter.

Figure 7:
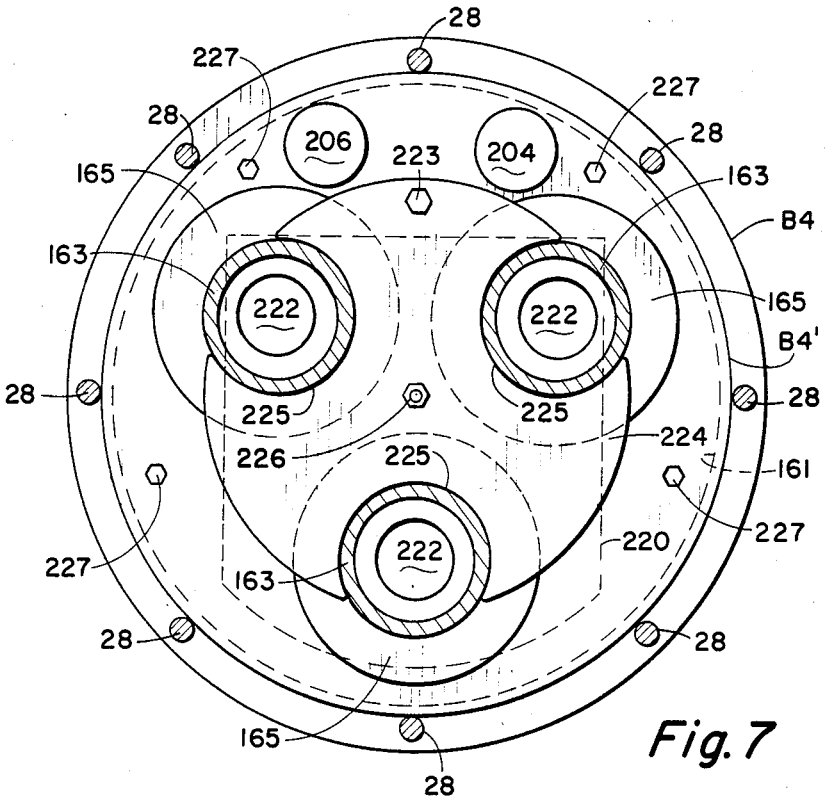
FIG. 7 is a cross-sectional view taken along line 7—7 of FIG. 5 through the housings for the fan motors, but with the fans and fan motors removed.

A trio of vacuum fans 166 are located between bulkheads B4 and B5. Each fan comprises a motor portion (not shown) covered by motor housing 163 and a fan portion (not shown) covered by a fan housing 165. The intake inlets 222 of these fans (see also FIG. 7) pass through bulkhead B4' and communicate with the vacuum-sealed chamber 164. (FIG. 7 is a cross-sectional view through the motor housings 163, but with the fan motors and fans removed.) These three fans 166 draw the suction intake air through the openings 222 thus creating the vacuum in compartment 164. Cylinders 204 and 206, which are threadedly received into appropriate openings cut in the top of bulkhead B4' and which are located above these fans, open alternately to allow suction to build up in vat chambers 174 and 176 alternately, which causes grit to be pulled in via tube 172, via connecting hose 58, via cleaning compartment hoses 56, and ultimately from the vacuum pickup nozzle 54 located in the Cleaning Head Module A.

Fans 166 are held in place against the rear wall bulkhead B4' by means of a metal fan clamping plate 224 which is positioned behind the fan housings 165 and attached to the bulkhead by a threaded rod 226 and a nut (not shown). The plate 224 is somewhat in the form of a clover leaf and is provided with three arcuate openings 225 which are slightly more than 180° and which are adapted to receive the housings 163 for the fan motors. The right surface (FIGS. 5 and 6) of the plate 224 bears against the left hand ends of the fan housings 165. A stabilizing rod 223 connects the upper end of plate 224 to bulkhead B4' to prevent rotation of the plate. A series of bolts 227 anchor B4' to B4 by clamping the circular housing 161 which forms the walls of vacuum chamber 164 together therebetween. The circular housing 161 of chamber 164 fits over a shoulder (not shown) on the right peripheral edge of B4' and into a groove (not shown) in the chamber side of bulkhead B4. All vacuum fan intake ports 222 open through B4' as do cylinders 204 and 206 via threaded mounting holes (not shown).

Also, in the Grit Supply Module B are a pair of electrically operated air compressors 168 and an air storage tank 170 which attach to bulkheads B3 and B4 as necessary. (These compressors may be located in other positions depending on available space in other size models of this present invention.) Compressed air, which is provided at 40–60 psi, is utilized to provide air power to many solenoid-operated valves which control the various cylinder-operated functions throughout the present invention and to provide actuating power for these cylinders.

Also, located in the top of the grit storage chambers 174 and 176 are a pair of grit access fill holes 228 and 229 through which cleaning grit is introduced into the hoppers. Said fill holes are further sealed off by a pair of filler caps 230 and 232. A hopper vent valve 234 (diagrammatically shown) communicates with the chambers 174 and 176 at the top on opposite sides of the divider wall 178 and connects to an actuating rod 236 which is operated by a pneumatic cylinder 238 (diagrammatically shown) to alternately vent hopper chambers 174 and 176 to atmosphere according to the LOGIC to be described later.

Below the two grit storage hoppers 174 and 176 is a single tube 240 which is open at its left end 241. This open-ended pipe 240 (open to take in outside air and to receive grit via ports 180 and 182) carries grit forward towards the central cavity 36 of the throwing hub 30 via hose 106. The open-end 241 provides a continuous air flow because of the vacuum created by the rotation of throwing wheel 30 through said hose 106, thus creating a dynamic force which propels the grit in the air current towards the throwing wheel 30.

Figure 13:
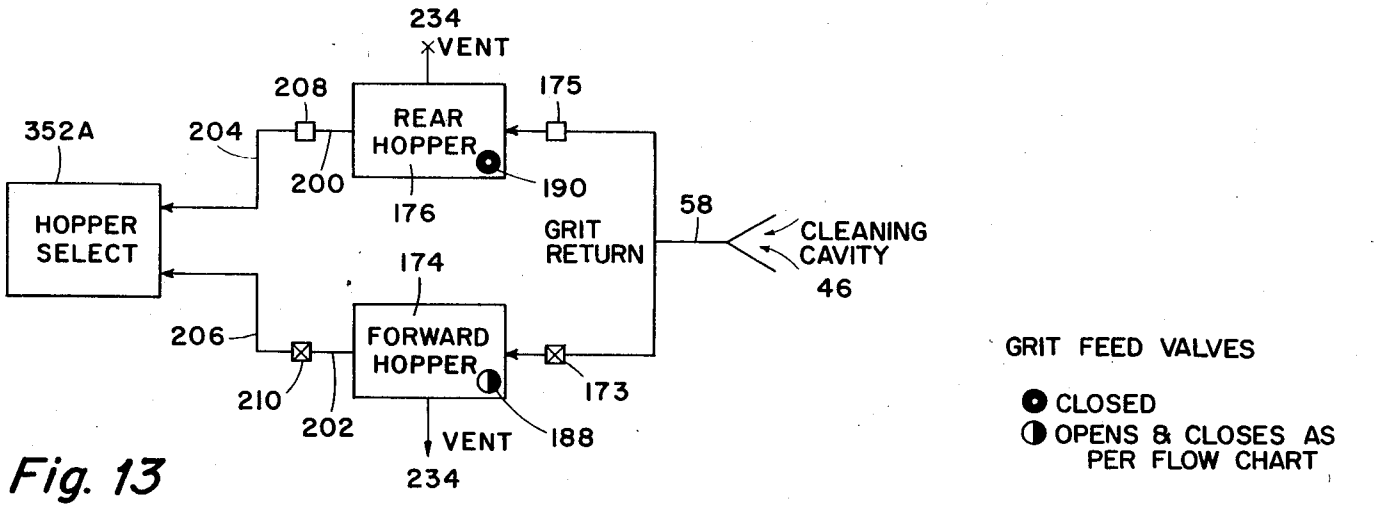
FIG. 13 is a schematic showing the sequence of operation of the hopper select vents and the hopper feeds.
Figure 14:
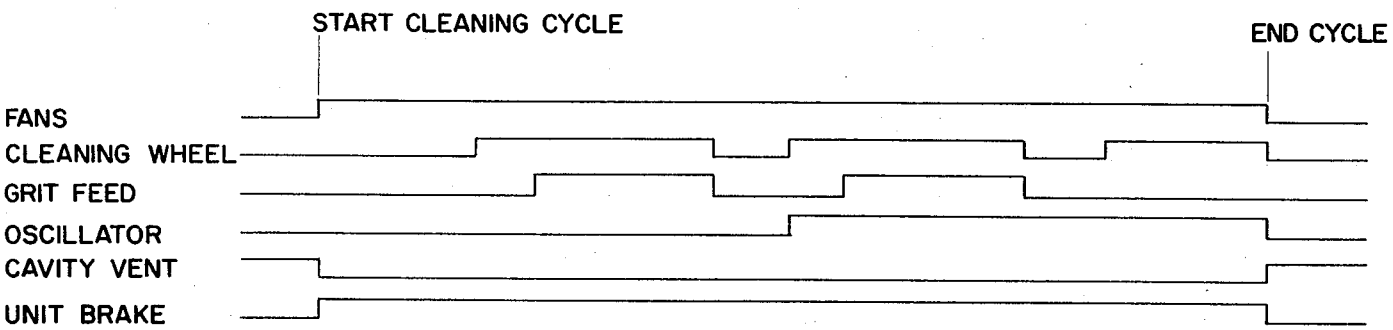
FIG. 14 is a flow chart illustrating the sequence of operations of the cleaning cycle and relative timing.
Figure 15:
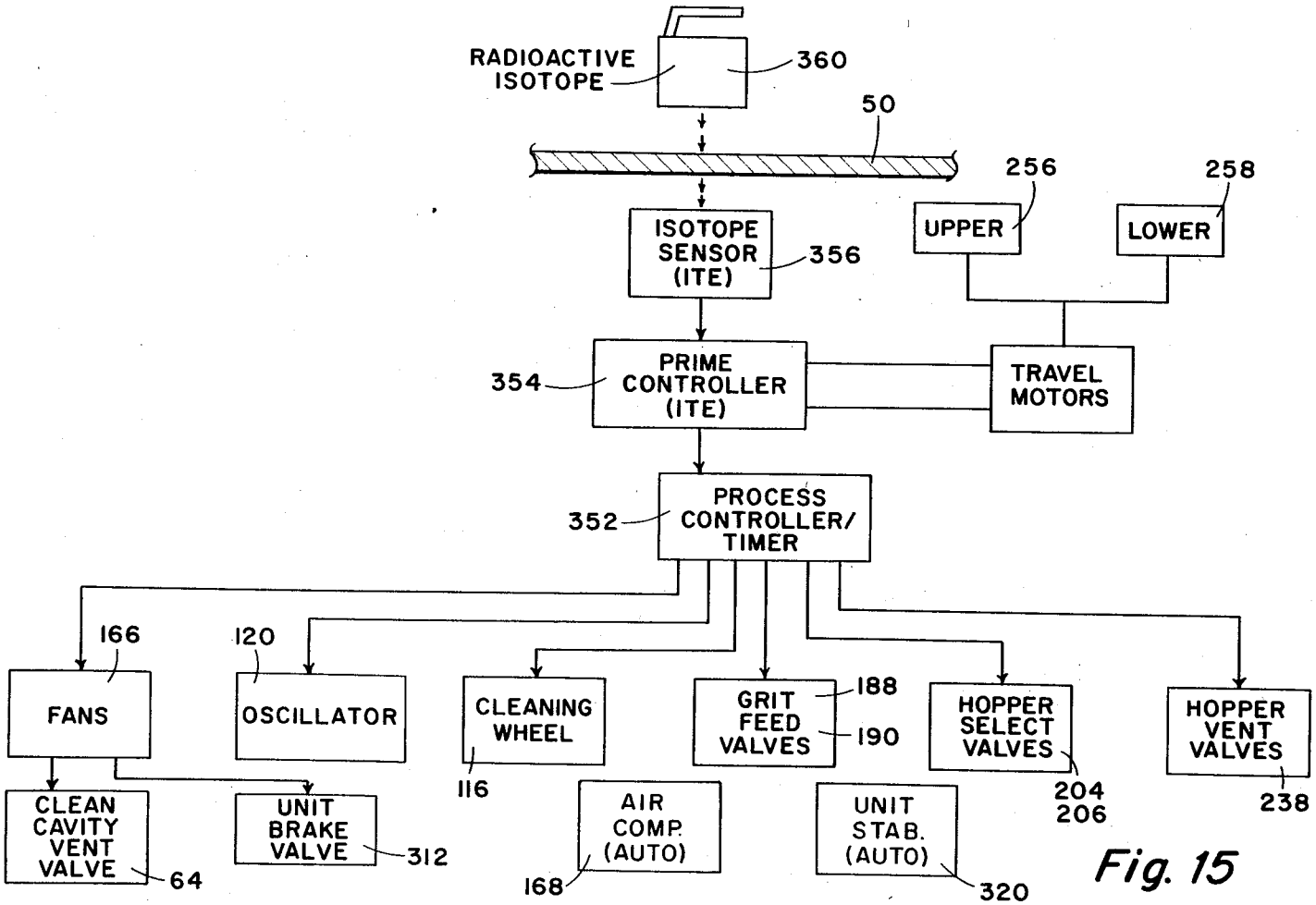
FIG. 15 is a schematic diagram illustrating how the radio-active signal (from outside of the pipe) triggers a programmed sequence of events to begin and what various components of the invention are involved at specific times.

The two air cylinder-operated rod valves 192 and 194, which alternately allow grit to drop from supply vats 174 and 176 into the flow control orifices as per the LOGIC flow chart in FIGS. 13, 14, and 15, both close, however, when the cleaning cycle is off. (The two chambers alternately drop grit into this air stream based on the above described vacuum controlled suction sequence which is described in the LOGIC illustrated later in FIGS. 13, 14, and 15.)

III. Prime Mover/Battery Pack Module C

The Grit Supply Hopper Module B is connected by another universal-joint 154 (see FIGS. 1, 8, 9, and 10) to the Prime Mover/Battery Pack Module C which broadly contains the following: (1) a pair of power drive units 242 (upper) and 244 (lower), (2) a battery pack supply section 246, (3) a brake mechanism 248, and (4) a stabilization mechanism or assembly 250.

Figure 8:
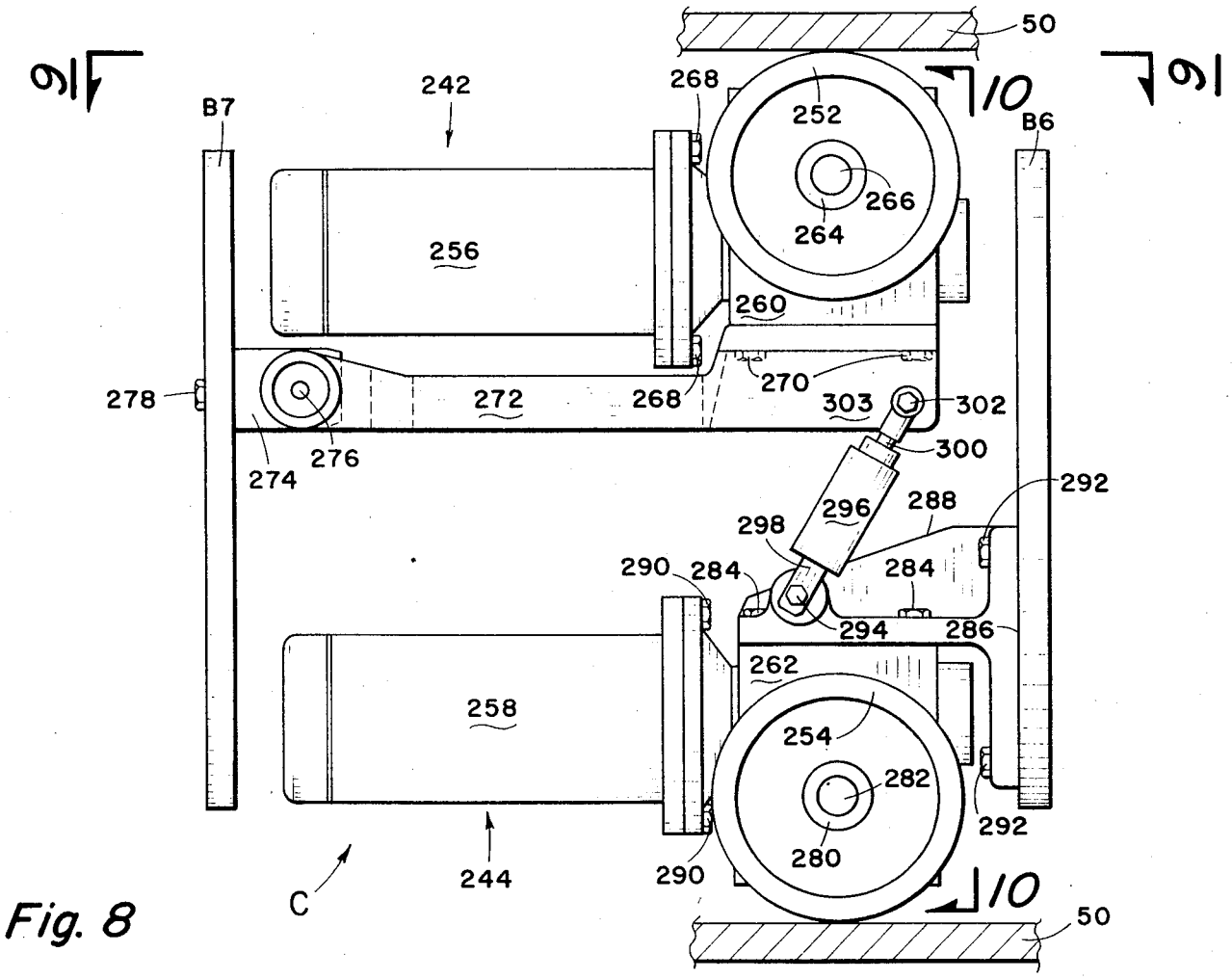
FIG. 8 is a front elevation, on a larger scale than FIG. 1, of the prime mover section shown at the upper right in FIG. 1.
Figure 10:
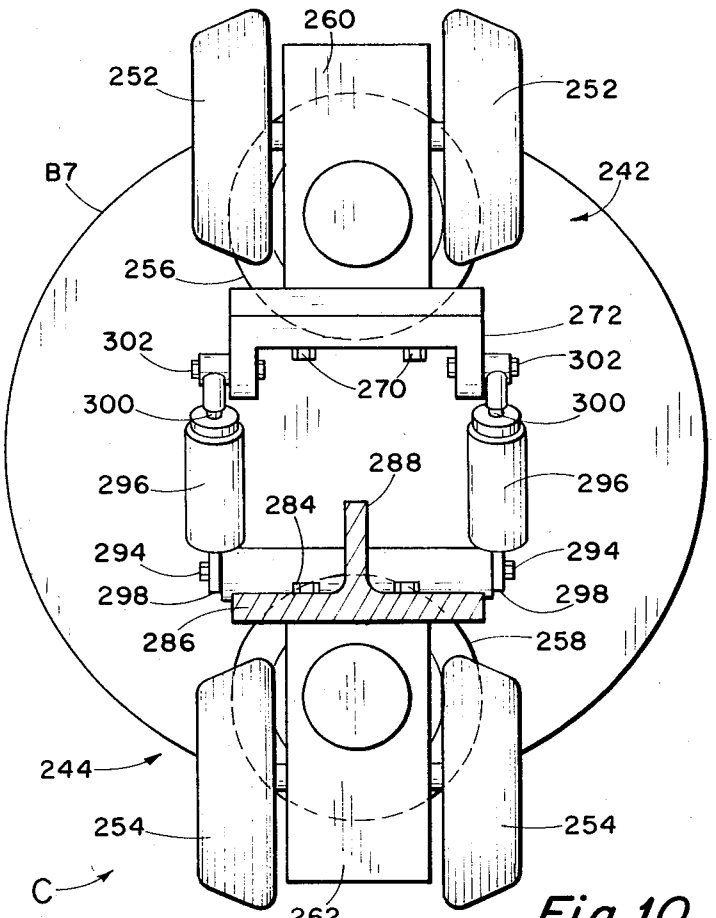
FIG. 10 is an end view of the elements shown in FIG. 8 as taken along line 10—10 of FIG. 1.
Figure 9:
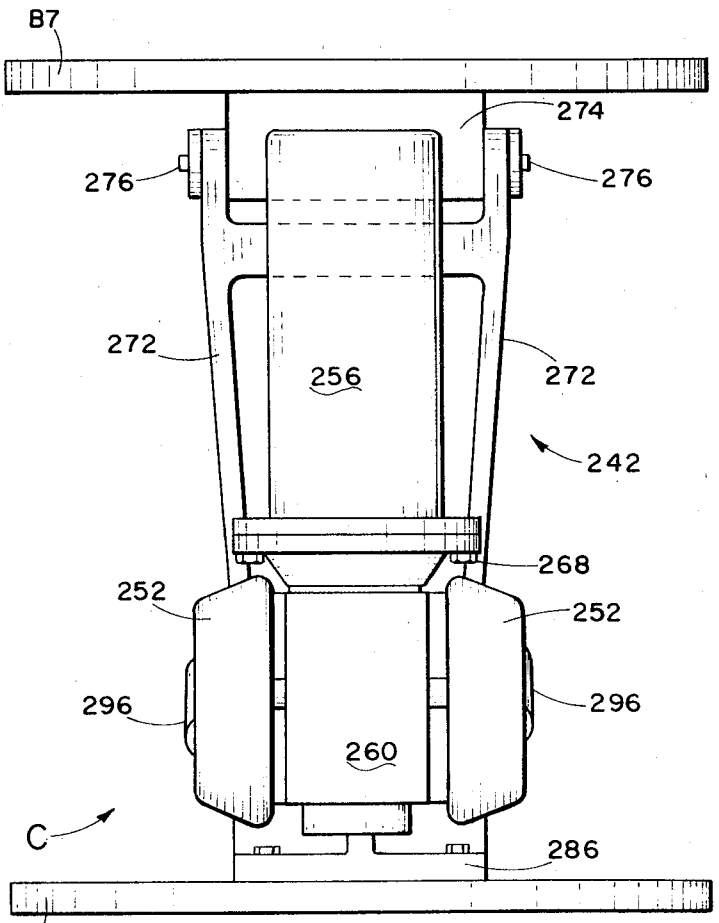
FIG. 9 is a plan view of the elements shwon in FIG. 8.

Each of the power drive units 242 and 244 shown in FIGS. 8, 9, and 10, consists of a pair of drive wheels 252 and 254, a pair of drive motors 256 and 258, and a pair of reducing gear boxes 260 and 262. The two pairs of wheels 252 and 254 are located one above the other in the same vertical plane. FIG. 10 shows an end view of the Prime Mover portion of the Module C. A pair of upper wheels 252, tapered at a 22° angle to provide maximum contact with the pipeline wall 50, make up one set of the Prime Mover power wheels which allow the present invention to travel from one weldment to another within the pipeline. These upper power wheels 252 are mounted on a pair of hubs 264 which fit over an output shaft 266 thus connecting them to the upper gear box 260 which is flange mounted by a series of bolts 268 to the upper drive motor 256.

The lower portion of the upper gearbox 260 connects by a series of bolts 270 to an A-frame yolk assembly 272 which attaches to a bracket 274 by means of a pivot bolt 276 passing therethrough. The bracket 274 attaches to bulkhead B7 by a pair of bolts 278.

The lower pair of drive wheels 254 are mounted on a pair of hubs 280 which fit over an output shaft 282 which passes through lower gear box 262. The upper portion of this lower gear box 262 is attached by a series of bolts 284 to a mounting bracket 286 which has an upper spine 288 down the center thereof; this gearbox 262 is further flange mounted to the lower drive motor 258 by a series of bolts 290. The mounting bracket 286 is further attached by a series of bolts 292 to bulkhead B6.

A pair of cylinders 296 having lower lug portions 298 are mounted to the upper spine 288 by bolts 294. (The lug is part of the cylinder.) A pair of actuating rods 300 at the other end of cylinders 296 connect by a pair of lugs 302 to the unattached end 303 of the A-frame yolk assembly 272.

The rods 300 plus the cylinders 296 are used to provide extra traction force through the upper power wheels 252 especially during periods when the lower wheels 254 encounter mud, rusty water, and/or oil or other debris within the pipeline walls 50. Therefore, these two sets of tapered wheels 252 and 254, mounted above each other in a vertical plane, and the two cylinders 296 help pre-load the workforce and keep the grit cleaning unit traveling down the pipeline.

The Prime Mover unit is connected together by a plurality of rods 28 (not here shown) which are bolted to bulkheads B6, B7, and B8; B7 and B8 form the beginning and end bulkheads encompassing the battery portion 246 of the Prime Mover Module C. FIG. 1 shows a side view of section 246 which contains three pairs of batteries 304 which make up the battery power pack. This series of batteries 304 allows the present cleaner invention to be used until the engine is able to generate its own power within the pipeline or until the unit can be brought out of the pipeline in case of engine failure.

FIG. 1 also shows a side view of the locking brake mechanism 248. A curved, locking brake shoe 306 is mounted on a lever arm 308 which attaches to a bracket 310 which is flange mounted to bulkhead B8 near the upper surface of the grit cleaner unit in close proximity to the upper inside surface of the pipeline wall 50. The brake shoe 306 is curved to fit a variety of pipe diameters.

The brake mounting bracket 310 is connected at its lower end to an air-actuated cylinder 312 which forces the lever arm 308 to set and lock the brake shoe 306 in place against the pipeline wall 50 when the cleaning process is running and to release and retract the brake shoe 306 when the process is not running and when the machine needs to travel down the pipe to the next weldment site. The sequencing is automatically controlled by the process controller timer 352.

A circuit in the process timer 352 controls the operation of the brake shoe 248. A relay contact is normally open when the machine is traveling through the pipeline from one weldment to another. The relay contact closes when the cleaning process starts and triggers the solenoid-operated air cylinder 312 to push the brake shoe 306 up against the pipeline wall 50. When the cleaning process ends, another signal causes the pneumatic cylinder 312 to release from its locked position thereby allowing the brake shoe 306 to disengage from pipeline wall contact.

At the front end of the battery compartment 246 and mounted on the upper edge of bulkhead B7 is the stabilization mechanism or assembly 250. A pair of high friction, rubber roller-castors or wheels 314 and 316 are attached to a stabilizer bar 318. One wheel (314) is canted 2° toward the left of the longitudinal axis of the pipeline; the other wheel (316) is positioned 2° toward the right of the longitudinal axis of the pipeline.

The stabilizer bar 318 is mounted on the vertical section of an L-shaped arm 320 which is further connected to and activated by a spring-centered pneumatic cylinder 322 which is triggered by a pair of mercury limit switches (not shown). For example, one switch is tripped when the machine rotates left more than 10° from it's vertical axis. This causes the stabilizer bar 318 to pivot or rotate thereby pushing the appropriate castor up against the pipe wall until an upright position is achieved. If the machine would over-correct and rotate 10° to the right, the other mercury limit switch would activate causing the other castor to be pushed up against the pipe wall thereby righting the cleaner.

The mounting of the wheels 314 and 316 at a 2° angle off center from the horizontal axis of the pipe allows the machine to assume a correct upright position slowly. So long as the machine remains within 10° of a normally upright position within the pipeline, the mercury switches are both de-energized thereby causing the stabilizing bar to remain level thus preventing both castor wheels from making contact with the pipe.

IV. Generator Module D

The Generator Module D (see now FIGS. 1, 11, and 12) broadly includes an extra large capacity fuel storage tank 324, an engine 326, a pair of alternators 328 and 330, and a pair of electronic controller boxes 352 and 354.

Figure 12:
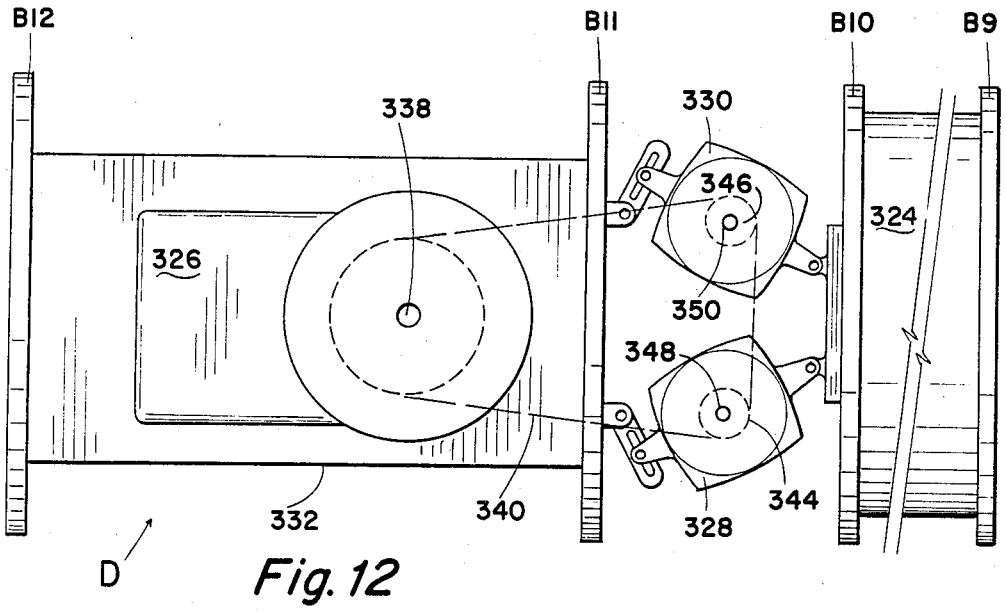
FIG. 12 is a plan view of the elements shown in FIG. 11.
Figure 11:
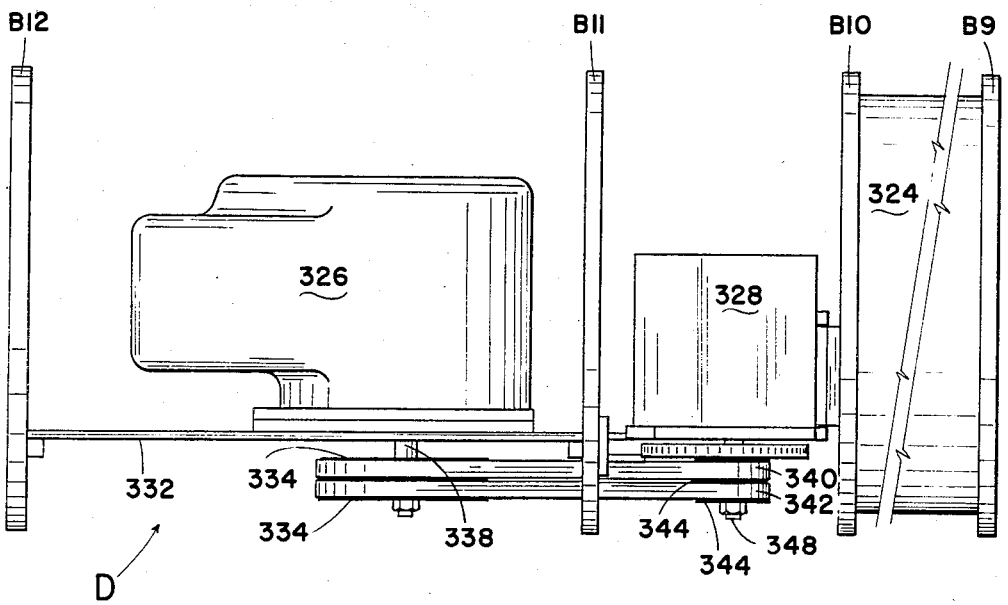
FIG. 11 is a front elevation, on a larger scale than FIG. 1, of the gasoline tank, the internal combustion engine and alternators shown adjacent the upper left hand end of FIG. 1.

At the rear end of this Battery Pack Module section 246 is bulkhead B8 which connects via a universal joint 154 to bulkhead B9, thus beginning the Generator Module D. The extra large capacity gasoline tank 324 is located between bulkheads B9 and B10 and is separately walled and sealed off therefrom. The gasoline or diesel engine 326 is mounted between bulkheads B11 and B12 adjacent the generators 328 and 330, which are found between the confines of bulkhead walls B10 and B11. The engine shown in FIGS. 1, 11, and 12 is mounted on and bolted to a metal plate 332 which extends across B11 and B12.

A pair of pulley wheels 334, connected to a spin input shaft 338 coming from the engine 326, are driven by a pair of pulley belts 340 and 342 which are further connected over a pair of generator pulley wheels 344 and 346 which are mounted on a pair of generator output shafts 348 and 350. These two belts, one coming from the engine and one coming from each of the two 24 volt alternators, operate one pair at a time by predetermined signal. For example, if one alternator would fail, controller 354 would be signaled which, in turn, would trigger the device to activate the other alternator. The electrical power produced by the alternators 328 and 330 drives the motors 256 and 258 of the Prime Mover drive assembly.

The electronics LOGIC connected with the present invention provides for several functional unit operations throughout the modules. (See now FIGS. 1, 2, 13, 14, and 15.) The unit cycle operating sequence and timing are controlled by such equipment as that manufactured by General Electric Corporation and International Test Equipment Company.

The electronics LOGIC center is disposed within a pair of controller modules 352 and 354 mounted to the left of bulkhead B12 in the Generator Module D, except for the isotope sensing unit 356 (see FIG. 2) which is mounted on a plate 358 located in the Cleaning Head Module A. Plate 358 is bolted in a suitable fashion to the rear end of gear box 122 located within the oscillation unit 118 and also to connecting rods 28 which hold various modular units of the grit cleaner together.

LOGIC: THE SEQUENCE OF FLOW OF A BASIC CYCLE

After a field weld W has been detected, an ITE (International Test Equipment Company, Tulsa, locating detector assembly—no model number assigned) standard isotope sensing unit 356 senses, receives, and translates a radio-active signal emitted by a low energy isotope source outside of the pipe 50. (The isotope sensing unit can be located anywhere along the grit cleaning unit's entire length. It merely bolts on as an electronic unit.) It is usually positioned along the cleaner a certain distance from the center of the throwing wheel hub 32 so that its exact location can be accurately measured to coincide with a manual placement of the isotope source outside of the pipeline wall 50.

An independent container 360 (see now FIG. 15), which holds a radio-active isotope within an inner, sealed lead box (not shown), is placed manually above the outside of the pipeline wall 50 a predetermined distance from at the center of the weld joint W. The grit cleaner engine 326 provides power to the unit as it travels down the pipe 50 until the isotope sensor 356 senses the transmitted radio-active signal coming from container 360. This signal, which then collapses the circuit to a grounded condition and electronically notifies the Prime Mover controller 354 and the human operator that the throwing wheel hub 32 in the Cleaning Module A is properly positioned at the center of the weldment, also causes the Prime Controller 354 (ITE's Control Module Model #316SC) to electronically command the power wheels 252 and 254 of the Prime Mover Module C to stop or reverse direction so as to be in the exact center of the weldment area. So the sensor 356 performs two functions: (1) it positions the unit, and (2) it gives a trigger signal to the automatic cycle controllers.

Once this trigger signal has been given, the cleaning cycle is then activated by the unit's process controller/timer 352. [ITE's Automatic Timing Control Model #410AC. Other models of electronic controllers are commercially available from companies such as General Electric.] Controller/timer 352 programs the cleaning sequence which tells the grit cleaner when to move, when to run the throwing wheel process, when to oscillate, and when to stop.

Once in the proper position, the controller/timer 352 gives the signal for the cleaning cycle to start. When one grit hopper supply tank, for example hopper 174, is open to the vacuum chamber created by the three intake fans, it is closed to the atmosphere thus creating a pull on the other tank's (176) flapper valve 175. [One flapper valve 173 is open, the other one 175 is pulled shut.] Also, the vat valve 180, located in the bottom of the grit supply hopper 174 that is under the vacuum, is closed. The other chamber 176 is open to the atmosphere by virtue of the position of valve 234, and although its flapper valve 175 is closed, its vat valve 182 is open. This arrangement allows the feeding of spent grit and blasted-off material to the hopper 174 and the flow of recovered grit from the hopper 176 to the grit supply tube 240. By means of a flip-flop, the controller reverses these conditions.

The machine of the present invention may require an external fan (not shown) to be placed at the end of the pipe 50 to provide additional "breathing air" for the engine 326 when the machine is moving along the pipeline. For example, when the machine is stopped and the cleaning process is in operation, the vacuum fans 166 are pulling some air through the port 48 in the forward rubber seal disc 38 and plate 42 to provide "breathing air" for the engine 326 while the process is running. However, when the cleaning process is over, the fans 166 are off and this source of "breathing air" is no longer available, and, thus, there would be a tendency for the engine to shut down as the machine commences to move along the pipeline. Therefore, another air source, the ventilation port 65, is cut in the rear seal 40 and plate 44. The number of ventilation ports may be increased depending on the size of engine to be used. If sufficient air does not pass through the port or ports 65 as the machine travels along the pipeline, it may be necessary or desirable to place an external fan (not shown) at one end of the pipeline (as suggested above) to increase the flow of air through these ports 65 so as to provide the amount of oxygen necessary to support combustion in the engine 326.

Figure 3:
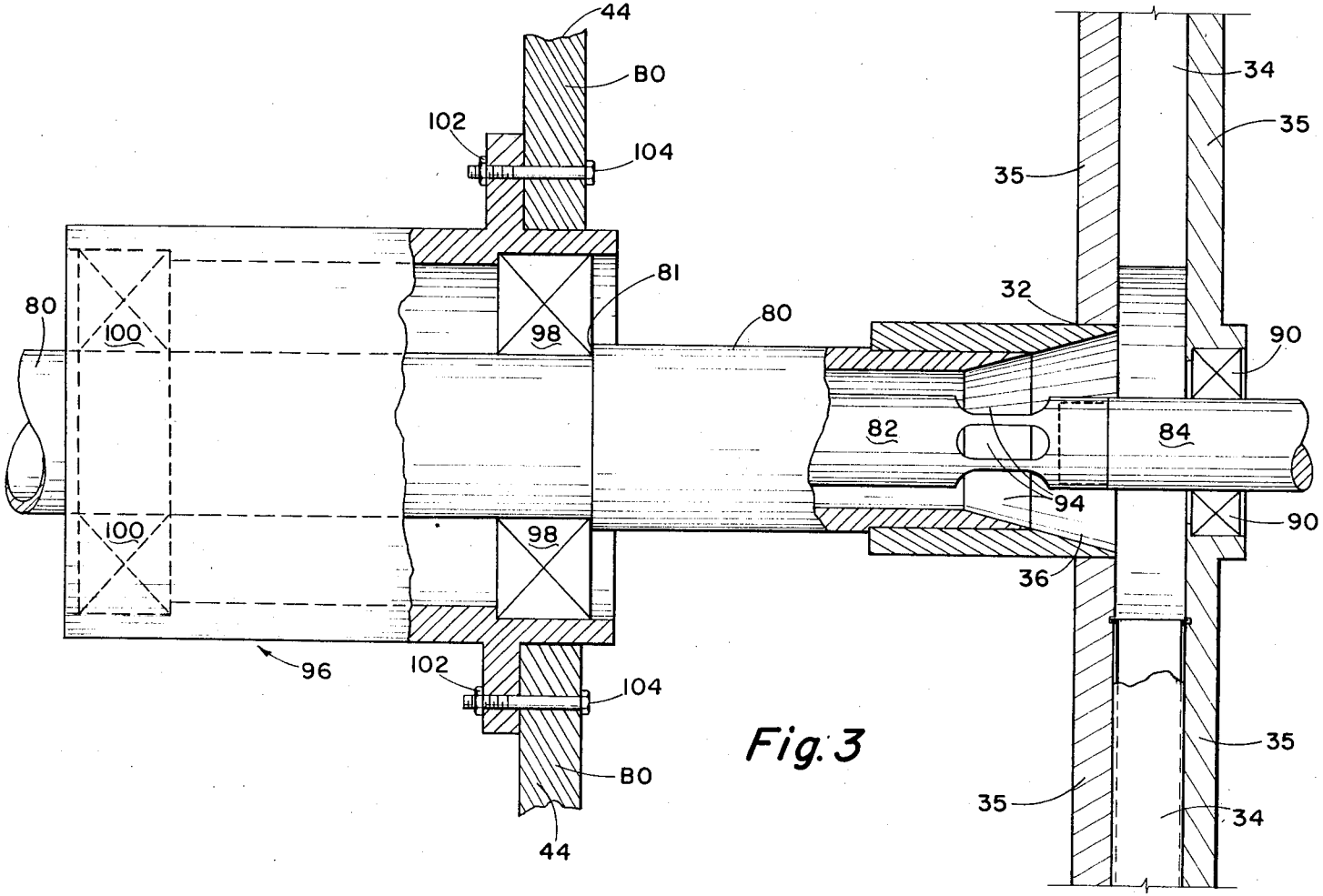
FIG. 3 is a front elevation, partly in secion and on a larger scale than FIG. 2, showing details of the throwing wheel hub and its associated bearing assembly taken from FIG. 2.
Figure 4:
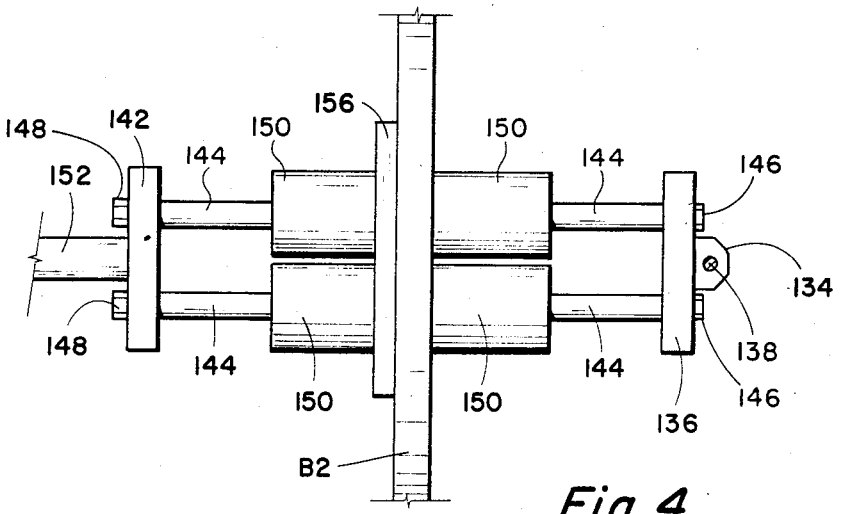
FIG. 4 is a plan view taken along line 4—4 of FIG. 2 showing details of the linear bushings and associated elements.

FIGS. 13, 14, and 15 are diagrammatic representations which have been added for a fuller understanding of the present invention. FIG. 13, for example, illustrates, in diagrammatic fashion, the disposition or more of the forward hopper 174 and the rear hopper 176 during a given cleaning cycle; FIG. 3 also illustrates the mode of the various valves associated with these two hoppers. A portion of the process controller/timer 352 is employed to control the various valves associated with the two hoppers. This portion of the process controller/timer is diagrammatically designated as 352A on FIG. 13. It should be also mentioned that FIG. 13 represents the condition where the rear hopper 176 is receiving returned grit from the hose 58 while the forward hopper 174 is forwarding grit to the grit supply tube 240 through the port 180. Thus, the hopper select 352A sends a signal to a solenoid operated valve (not shown) to operate the pneumatic cylinder 204 to open the disk valve 208; this opens the tube 200 to the vacuum chamber 164. At the same time, the hopper select 352A sends a signal to the vent valve 234 so as to close the rear hopper's vent to the atmosphere and open the forward hopper's portion of this vent to the atmosphere. The suction on the tube 200 will cause the flapper 175 to open and the flapper 173 to close as indicated on FIG. 13. The hopper select 352A also sends a signal to actuate the two needle valves 188 and 190. In the case of FIG. 13, the needle valve 188 is open for the purposes of that cleaning cycle but can be further opened and closed as will be explained further in connection with the description of FIG. 14. The signal sent by the hopper select 352A to the needle valve 190 is such that this needle valve is closed during the entire cleaning cycle represented by FIG. 13. For the next cleaning cycle however, the conditions shown in FIG. 13 will be reversed. That is, the forward hopper 174 is adapted to receive grit from the hose 58 while the rear hopper 176 is adapted to feed grit to the supply tube 240 through the valve 190.

Turning now to FIG. 14, this figure shows the dispositions of the fans 166 ("FANS"), the cleaning wheel 32 ("CLEANING WHEEL"), the grit feed valve 188 or 190 ("GRIT FEED"), the oscillator motor 120 (OSCILLATOR"), the vent valve 64 ("CAVITY VENT") and the brake 248 ("UNIT BRAKE") during an entire cleaning cycle. The horizontal lines opposite the above legends represent "on" or "off" or "open" or "closed" as the case might be. For an up condition of the line the corresponding item is on or open; when the line drops down, the item is turned off or closed. It will be assumed that the machine is presently positioned in the pipeline and that the machine is waiting for the next signal from the LOGIC controller to "Start Cleaning Cycle". At this point, the brake 248 is fully engaged, the forward vent 64 is fully closed and the fans 166 are turned on to commence the cleaning cycle.

At the commencement of the cleaning cycle, the condition shown in FIG. 13 will also obtain except that the valve 188 will be momentarily closed so that there is suction to the cleaning cavity 46 before the cleaning wheel commences to rotate and before grit or abrasive particulate material is supplied to the grit supply tube. After the fans 166 have been operating for a predetermined period of time, the forward motor 116 will be powered to rotate the cleaning wheel 32 as represented by the first rise in the line corresponding to "CLEANING WHEEL". When the cleaning wheel gets up to speed, the suction created within the cavity 36 inside the hub 32 will cause suction to be transmitted through the hose 106 back to the grit supply tube 240 and through the open end 241. After the wheel has been rotating a predetermined period of time, then the "GRIT FEED" (which is in the mode of FIG. 13) is actuated to the extent that the valve 188 is now opened to permit grit to drop through the port 180 into the tube 240 as represented by the first rise in the line corresponding to "GRIT FEED". The grit is sucked into the cavity 36 and is propelled outwardly through the tubes 34 against the weld W. Both the grit feed and cleaning wheel are turned off in anticipation of the reversal of rotation of the cleaning wheel. The grit feed is actually turned off a few seconds before the cleaning wheel is turned off so that there will be no grit from the open end 241 to the chamber 36 at the time the cleaning wheel actually stops rotating. After a pause long enough for the cleaning wheel to cease rotation or nearly so, a signal is sent to the motor 116 to rotate the cleaning wheel in the reverse direction and, at the same time, a signal is sent to the motor 120 to cause oscillation of the entire cleaning unit 30 in the manner previously described. This oscillation, as indicated by the first rise in the line corresponding to "OSCILLATOR", will continue to the end of the given cleaning cycle. In the interim, however, the cleaning wheel is stopped or slowed down and reversed while the grit feed is off. This will allow the cleaning wheel to fully dispense any abrasive material remaining in the grit feed lines and, of course, the suction will remove all grit and blasted-off material and return it to the rear hopper 176. The feed unit oscillates back and forth so that the vacuum tube 54 will suck up whatever grit and blasted-off material is left in the cleaning area.

The times broadly referred to above, as represented by the rises and falls on FIG. 14, can be varied depending upon the cleaning requirements of the given pipeline. For example, the fans start first. It is not desirable to turn the fans and the wheel motor on at the same time because of the initial amperage draw. When the fans get up to speed, after about five seconds, the wheel motor is energized. The wheel motor takes about twenty-seven seconds to get up to speed. After about forty-five seconds, the grit valve 188 (or 190) is opened. The cleaning wheel will blast grit directly over the weld seam itself for approximately a minute to a minute and a half. The grit feed and cleaning wheel are then turned off in that order and the oscillation mode begins. The wheel has been spinning at approximately 3200 RPM's so it is given approximately thirty seconds to slow down after which the wheel motor is given an opposite rotational signal and the wheel starts spinning in the opposite rotary direction. Twenty seconds after that, the grit feed turns back on again. After about another minute to a minute and a half the grit feed and the cleaning wheel are turned off in that order and the grit feed remains off for the remainder of the cycle. After about thirty seconds the cleaning wheel is turned back on for rotation in a rotary direction opposite to its last rotary movement and the wheel continues to spin for approximately a minute while the cleaning unit continues to oscillate. The spinning wheel provides turbulence in the cleaning cavity while the cleaning unit oscillates back and forth to suck up all of the grit in the cleaning cavity. Just prior to the end of the cleaning cycle, the process controller/timer 352 sends a signal to the micro-switch 162 so that, on the final revolution of the disk 126, the pin 159 will contact the lever arm to open the limit switch 162 and shut off the motor 120 causing the wheel 32 to come to rest directly over the weld W.

FIG. 15 is a diagrammatic representation of the major components of the overall system. After the machine has been placed in the pipeline with the engine 326 operating, the alternators 328 will be supplying current to the batteries 304 which, in turn will be supplying electrical power to all of the various units requiring electrical power, although the time when the power is supplied to such units may be determined by the process controller/timer 352. Electrical power will be immediately applied to the compressor 168 which supplies compressed air to the air reservoir 170. Air under pressure is supplied from the reservoir 170 to all air operated units through various solenoid valves which are controlled by the prime controller 354 and/or the process controller/timer 352 with the exception of cylinder 296 which is manually operated at the time the machine is inserted in the pipeline.

At the time that the machine is inserted in the pipeline, it is generally disposed on a trough sufficiently long to contain the machine and having a curvature corresponding to the lower curvature of the pipeline. The trough is brought up against the pipeline so that the curvature of the trough is in abutting alignment with the lower end of the pipeline. The engine 326 is started and the machine is "jogged" into the pipeline by intermittently actuating the motors 256 and 258. When both sets of wheels 252 and 254 are within the pipeline, a manual valve (not shown) is opened to actuate the cylinder 296 at which time the upper wheels 252 are urged upwardly into firm engagement with the upper portion of the pipeline wall. The control can now be switched to automatic and the remaining operations can be controlled by the radio-active isotope in the hand held container 360.

As shown in FIG. 2, the isotope sensor 356 is located a predetermined distance away from the center of the wheel 32. If this distance is, for example, eighteen inches, then the hand held isotope source 360 should be placed eighteen inches to the left of the weld W, assuming that the cleaning machine shown in FIGS. 1 and 2 is moving to the left in proceeding from one weld joint to the next. Returning now to a further consideration of FIG. 15 and assuming that the hand held isotope source 360 has been placed at the proper location on the pipeline, the machine will have moved and stopped with the isotope sensor 356 located physically directly below the hand held source 360. The brakes will have been engaged and the system is waiting for a signal from the process controller/timer 352 to commence the cleaning cycle. Although the system could be set up in such a way that the cleaning cycle would commence automatically upon the stopping of the machine at the proper location, preferably the machine, as in the present case, is designed for a further signal to be given prior to the commencement of the cleaning cycle. This signal is given merely by removing the hand held source 360 from the pipeline. At this time the isotope sensor 356 (which was actuated by the isotope source 360 and which sent a signal to the prime controller 352) sends a reverse signal (upon removal of the source 360) to the prime controller 354. In effect, the isotope sensor 356 actuates a stepping switch (not shown) in the prime controller 354; the placement of the source 360 over the sensor 356 causes this stepping switch to move half-way to the next step. The subsequent removal of the source 360 from its influence over the sensor 356 causes this stepping switch to remove all the way to the next step. Assuming that this next step is the commencement of the cleaning cycle, then the machine will commence to clean the pipe weld W in the manner described previously. However, should the operator of the machine desire some alternate action, such as movement of the machine in a reverse direction back to the previous weld joint, then alternate placement and removal of the source 36 over the sensor 356 will cause the stepping switch within the prime controller 354 to move to whatever position this operator desires consistent with the demands at the time.

Purely by way of example, the stepping switch (not shown) referred to above has four main positions or steps. The first position is "Forward"; the second position is "Reverse"; the third position is "Stop"; and the fourth position is "Process", or, in other words, the cleaning cycle itself. In the "Forward" position, the brake 248 will be off (by de-energizing the cylinder 312) and the motors 256 and 258 will be actuated to move in a "Forward" direction which, of course, is arbitrary with respect to the machine unless and until it is established which end of the machine is the "Forward" end. For the purposes of this application, the end containing the control elements 352 and 354 mounted on bulkhead B12 will be considered the "Forward" end of the machine. Therefore, in relation to FIGS. 1, 2 and 8, energizing the motors 256 and 258 to move in a "Forward" direction will mean that the machine moves towards the left with respect to the above mentioned figures. Since it is necessary to back the machine out, in numerous instances, a "Reverse" condition must be available to allow the machine to move towards the right with respect to FIG. 1 et seq. In the "Reverse" and "Forward" modes, the motors 256 and 258 are energized, the engine 326 is on, the alternators are charging the batteries 304, the stabilizing mechanism 320 is on, the vent valve 64 is open, the air compressor 168 is running, the cylinder 296 is pressurized and everything else is either off or closed. In the "STOP" position, the power is removed from the motors 256 and 258, the cylinder 312 is pressurized to engage the brake 248 and the remainder of the system is the same as in the forward or reverse mode. When the stepping switch is in the "Process" mode, the machine operates as previously described with particular reference to FIGS. 13, 14 and 15.

There are three specific conditions where the machine is stopped: first, whenever the radio-active isotope 360 is disposed on the pipeline 50 directly above the sensor 356; secondly, when the stepping switch is in the "Stop" mode; and thirdly, at the completion of the "Process" mode. Assuming that the machine has completed a cleaning cycle at a given weld joint W, the machine will be at the end of the process mode, the operator will then place the radio-active source 360 on the pipe over the sensor 356 and the sensing switch will move halfway to the next step. The operator will then remove the source 360 and the stepping switch will move all the way to the next step which is the "Forward" position. Now the machine will commence moving towards the left and towards the next weld joint. The operator will have marked a position eighteen inches to the left of the next weld joint for the proper placement of the source 360 for the cleaning operation at that weld joint. However, it is necessary to take the stepping switch through the "Reverse" mode and through the "Stop" mode before the "Process" mode can commence. Accordingly, the operator will place the source 360 some three feet, for example, to the left of the proper position for this source as referred to immediately above. When the machine moves such that the sensor 356 is below the actuator 360, the machine will stop some three feet plus eighteen inches beyond this second weld joint. By virtue of the fact that the sensor 356 is now below the source 360, the stepping switch will have stepped halfway towards the next step. Now the operator again removes the source 360 from the pipe and the stepping switch moves all the way to the next position which is the "Reverse" position. Immediately thereafter, the operator moves the isotope source to the mark 18 inches to the left of the second weld joint and the machine will travel in a reverse direction to this point at which time it will stop and the stepping switch will move halfway to the next position. When the operator now removes the source 360, the machine will be in the "Stop" position. If it is desired to leave the machine at this point for a period of time, it can be done conveniently. If the operator wishes to initiate the cleaning cycle, he merely places the isotope source 360 over the sensor 356 and thereafter removes it to cause the stepping switch to move to the "Process" mode and the cleaning cycle begins as described above.

At the conclusion of a cleaning cycle, the machine will generally sound a horn (not shown) at which time the operator will place the hand held unit 360 over the isotope sensor 356 and remove it to actuate the prime controller for the next step, preferably "Forward" to the next weld. At the same time, the operator will place the same or another hand held source 360 eighteen inches to the left of the next weld joint (or three feet beyond this point, if it is necessary to take the machine through the "Reverse" mode and the "Stop" mode, as described above).

In FIG. 15, the air compressor 168 and the unit stabilization system 320 are not controlled directly or indirectly by the prime controller 354; these units operate whenever the engine (or batteries) are "on". The other instrumentalities connected to the prime controller 354 or the process controller/timer 352 are dependent upon signals initiated by the radio-active isotope source 360. For safety purposes, a toggle switch (not shown) is located at each end of the machine; in the event that the machine proceeds out of either end of the pipeline, the toggle switch at that end can be thrown to stop the movement of the machine immediately. A further safety feature (not shown) can be incorporated into the machine to stop the same automatically after a predetermined distance of movement, say fifty feet, in the event that the machine "gets away" from the operator and travels beyond the next weld joint which would normally be about forty feet away.

Whereas the present invention has been described in particular relation to the drawings and diagrams attached hereto, it should be understood that other modifications, apart from those shown or suggested herein may be made within the spirit and scope of this disclosure.

What is claimed is:

1. A machine for cleaning the interior uncoated surfaces surrounding the weld joints in an otherwise internally coated pipeline comprising a first plate mounted on the machine and extending transversely across the pipeline when the machine is disposed within the pipeline, a second plate mounted on the machine in spaced parallel relation with the first plate, a first resilient member mounted on the first plate and having a circular periphery adapted to engage the inner periphery of the pipeline wall, a second resilient member mounted on the second plate and having a circular periphery adapted to engage the inner periphery of the pipeline wall, said first and second plates with their attached resilient means forming a closed cleaning chamber sealed at its ends with respect to the pipeline, a hollow rotatable hub mounted on the machine and within the cleaning chamber and rotatable on an axis substantially co-axial with the longitudinal central axis of the pipeline, a plurality of hollow tubes extending radially outward from the hub and in communication with the interior of said hub, means for rotating said hub whereby air is forced outwardly through said tubes to create a partial vacuum within the interior of said hub, means for supplying particulate abrasive material to the interior of said hub whereby the vacuum created upon rotation of said hub will cause said particulate material to be propelled outwardly against the interior of the pipeline wall, means for moving the machine so as to position the radial tubes in alignment with a weld joint whereby, upon rotation of said hub and upon supplying said hub with particulate abrasive material, said tubes will propel the particulate material against the weld joint to clean the same by a sand blasting effect, means acting in timed response to the initial rotation of said hub for oscillating said plates and hub as a unit longitudinally with respect to weld joint whereby said tubes will move alternately back and forth across said weld joint to clean the entire weld joint area, and means for removing accumulated spent particulate material and blasted-off material continuously from said cleaning chamber.

2. A machine as set forth in claim 1 wherein said means for removing accumulated spent particulate material and blasted-off material continuously from said cleaning chamber comprises an atmospheric vent tube communicating through one of said plates to said cleaning chamber, a vacuum suction head communicating through the other said plates to the bottom of said chamber and a source of vacuum mounted on the machine and connected to said vacuum suction head.

3. A machine as set forth in claim 2 wherein said source of vacuum includes a first hopper mounted on the machine, a second hopper mounted on the machine and separated from the first hopper by a partition wall, a grit return tube having an outer end connected to said vacuum suction head, said grit return tube extending into said second hopper through said partition wall and into said first hopper, said grit return tube having a first opening communicating with said first hopper and a second opening communicating with said second hopper, a first flapper valve over the first opening on said grit return tube, a second flapper valve over the second opening in said second hopper, a vacuum chamber mounted on said machine, a first vacuum suction tube extending from said vacuum chamber into said first hopper, a second vacuum suction tube extending from said vacuum chamber into the second hopper, said first and second vacuum suction tubes each having sealable openings within said vacuum chamber, a first disc valve mounted within said vacuum chamber for sealing the sealable end of said first vacuum suction tube, a second disc valve mounted within said vacuum chamber for sealing the sealable opening of said second vacuum suction tube, means for alternately opening said first disc valve and said second disc valve whereby suction is applied alternately to the first and second hoppers, respectively, an upper atmospheric vent valve connected to said hoppers, means for operating said upper atmospheric vent valve to open one of said hoppers to the atmosphere while simultaneously closing off the other hopper to the atmosphere, whereby when the first disc valve is opened, the atmospheric vent valve for the first hopper is closed and the atmospheric vent valve for the second hopper is opened such that vacuum is supplied to the first hopper to close the second flapper valve and to open the first flapper valve to draw spent particulate material and blasted-off material from said grit return tube into said first hopper.

4. A machine as set forth in claim 3 including a first lower opening in said first hopper to permit the discharge of returned particulate material therefrom, a second lower opening in said second hopper to permit the discharge of returned particulate material thereform, a first needle valve mounted within said first hopper and operable to close said first lower opening, a second needle valve mounted in said second hopper and operable to close said second lower opening, a horizontal grit supply tube in communication with said first and second lower openings of said first and second hoppers and having an open end to permit the introduction of air into said grit supply tube, said grit supply tube having another end communicating with the interior of said hub and constituting the means for supplying particulate abrasive material to the hub.

5. A machine as set forth in claim 1 wherein the various components mounted on the machine are located between a plurality of spaced bulkheads and wherein certain adjacent bulkheads are connected by means of universal joints whereby the machine is articulated.

6. A machine as set forth in claim 1 wherein said hub is mounted for rotation on a rotatable hollow shaft which is rotatable around a non-rotatable hollow supply tube which constitutes the means for supplying particulate abrasive material to the interior of said hub, said hollow supply tube being provided with a plurality of emission ports opening into the interior of said hub, said hub being provided with a central tapered cavity surrounding the emission ports and tapering outwardly at a 21° angle to a location where the hub connects with said radial tubes.

7. A machine as set forth in claim 1 wherein said means for moving the machine comprises a first pair of drive wheels engageable with the lower interior portion of the pipeline wall, a first drive motor for driving said first pair of drive wheels in both forward and reverse directions, a second pair of drive wheels mounted above said first pair of drive wheels and engagable with the upper portion of the interior of the pipeline wall, a second drive motor for driving said second pair of drive wheels in both forward and reverse directions, and means for urging said second pair of drive wheels upwardly away from said first pair of drive wheels.

8. A machine as set forth in claim 1 including a movable brake shoe mounted on the machine and means for moving the brake shoe into contact with the pipeline wall to prevent movement of the machine during a cleaning process.

* * * * *